US010428490B2

(12) United States Patent
Wagner

(10) Patent No.: US 10,428,490 B2
(45) Date of Patent: Oct. 1, 2019

(54) EXCAVATOR WITH RIGID FORCE TRANSFER LINK

(71) Applicant: Guangxi LiuGong Machinery Co., Ltd., Liuzhou, Guangxi (CN)

(72) Inventor: Edward Wagner, Guangxi (CN)

(73) Assignee: Guangxi LiuGong Machinery Co., Ltd., Liuzhou, Guangzi (CN)

( * ) Notice: Subject to any disclaimer, the term of this patent is extended or adjusted under 35 U.S.C. 154(b) by 0 days.

(21) Appl. No.: 16/218,891

(22) Filed: Dec. 13, 2018

(65) Prior Publication Data

US 2019/0112780 A1 Apr. 18, 2019

Related U.S. Application Data

(63) Continuation of application No. 15/804,811, filed on Nov. 6, 2017, now abandoned.

(30) Foreign Application Priority Data

Dec. 27, 2016 (WO) ..... PCT/CN2016/112404

(51) Int. Cl.
*E02F 9/18* (2006.01)
*E02F 3/38* (2006.01)
(Continued)

(52) U.S. Cl.
CPC ..... *E02F 3/382* (2013.01); *E02F 3/38* (2013.01); *E02F 9/14* (2013.01); *E02F 9/18* (2013.01); *E02F 9/2217* (2013.01); *E02F 3/32* (2013.01)

(58) Field of Classification Search
CPC ..... E02F 3/382; E02F 9/18
See application file for complete search history.

(56) References Cited

U.S. PATENT DOCUMENTS 3,388,819 A * 6/1968 Przybylski ..... E02F 3/382 414/694
3,392,855 A * 7/1968 Przybylski ..... E02F 3/302 414/694

(Continued)

FOREIGN PATENT DOCUMENTS

DE 102008018451 A1 2/2010
JP 60168828 A * 9/1985 ..... E02F 3/382

(Continued)

OTHER PUBLICATIONS

Extended European Search Report in corresponding EP17203823.4 dated Nov. 2, 2018.

(Continued)

*Primary Examiner* — Gerald McClain
(74) *Attorney, Agent, or Firm* — Young Basile Hanlon & MacFarlane, P.C.

(57) ABSTRACT

An excavator includes an articulated boom and a balancing mechanism that assists a movement of the articulated boom from a lower position to an upper position by applying a pulling force on the articulated boom. The balancing mechanism comprises a balancing member that generates an assisting force and a force transfer mechanism that couples the balancing member with the articulated boom. The force transfer mechanism comprises a link mechanism that transfers the assisting force from the balancing member to the articulated boom at a transmission ratio independent from a position of the articulated boom.

13 Claims, 26 Drawing Sheets

(51) Int. Cl.

| | |
|---|---|
| ***E02F 9/14*** | (2006.01) |
| ***E02F 9/22*** | (2006.01) |
| *E02F 3/32* | (2006.01) |

(56) References Cited

U.S. PATENT DOCUMENTS

| | | | | | |
|---|---|---|---|---|---|
| 3,856,161 | A * | 12/1974 | Baron | E02F 3/30 | 414/694 |
| 4,046,270 | A * | 9/1977 | Baron | E02F 3/30 | 414/694 |
| 4,085,854 | A * | 4/1978 | Baron | E02F 3/30 | 414/694 |
| 4,221,531 | A * | 9/1980 | Baron | E02F 3/302 | 414/694 |
| 4,768,762 | A | 9/1988 | Lund | | |
| 6,725,584 | B2 * | 4/2004 | Inoue | E02F 3/3604 | 37/403 |

FOREIGN PATENT DOCUMENTS

| | | | | |
|---|---|---|---|---|
| JP | 2008019680 | A | * | 1/2008 |
| JP | 20080019680 | A | | 1/2008 |
| KR | 20100018969 | A | | 2/2010 |
| WO | 2008013466 | A1 | | 1/2008 |
| WO | 2018119678 | A1 | | 7/2018 |

OTHER PUBLICATIONS

European Search Report in corresponding EP17203823.4 dated Oct. 23, 2018.

* cited by examiner

EXCAVATOR WITH RIGID FORCE TRANSFER LINK

CROSS-REFERENCE TO RELATED APPLICATION

This application is a continuation of U.S. Ser. No. 15/804,811 filed Nov. 6, 2017, which claims priority from PCT/CN2016/112404 filed Dec. 27, 2016. These applications are incorporated herein by reference in their entirety for all purposes.

TECHNICAL FIELD

The technical field relates to an excavator comprising a balancing mechanism.

BACKGROUND

Excavators, also called diggers, are widely used in the market e.g. for digging and material handling. Such excavators typically comprise a boom, a bucket arm, a bucket and a cab on a rotating platform which is supported by an undercarriage having tracks or wheels. Known excavators use hydraulic power for actuating the different elements of the excavator, in particular for moving the boom, the bucket arm and the bucket. Such configurations are, however, often inefficient and expensive.

Accordingly, it is desirable to at least address the foregoing. In addition, other desirable features and characteristics will become apparent from the subsequent summary and detailed description, and the appended claims, taken in conjunction with the accompanying drawings and this background.

SUMMARY

It may be desirable to provide an improved excavator which is more efficient and cost-saving.

Described in a first embodiment is an excavator comprising an articulated boom and a balancing mechanism. The balancing mechanism at least partially assists a movement of the boom from a lower position to an upper position by applying a pulling force on the boom. Accordingly, the lifting operation of the excavator comprising the above described articulated boom in connection with the balancing mechanism is more efficient compared to systems which do not comprise such an at least partial assistance of a movement of the boom from a lower position to an upper position.

A boom in the context of the present application may comprise multiple links and may comprise an attachment portion to which attachments like a bucket, a breaker, grapple or auger may be attached. However, the term boom may also refer to a main arm of an excavator only, that is to say to the arm of a link system which is directly coupled to a platform which also carries an operator's cab. A bucket arm may be attached to such a boom.

Furthermore, in the context of the present disclosure, "articulated" may include any connection allowing a defined movement from a lower position to an upper position. For example, the boom may be articulated in that it is hingedly held, e.g. hingedly coupled to a platform of an excavator. According to the first embodiment, the balancing mechanism at least partially assists a movement of the boom from a lower position to an upper position which is done by applying an assistive pulling force on the boom. For example, the term "at least partially assisting" may include configurations in which the movement is fully assisted from the beginning to the end and configurations in which an assistance is provided only provided in certain ranges or points of the movement of the boom, e.g. at the beginning of the movement of the boom. In other words, any kind of application of a pulling force assisting the boom in moving from the lower to the upper position can be regarded as "partially assisting".

According to a further embodiment of the present disclosure, the balancing mechanism comprises a balancing member for generating an assisting force and a force transfer mechanism indirectly and force-transmittingly coupling the balancing member with the boom.

By coupling the balancing member with the boom in this way, the variability of the overall construction of the excavator is improved as the balancing member can be placed at any suitable position of the excavator, e.g. on the opposite side of a coupling position of a platform or top frame of an excavator where the boom is coupled to the same. In other words, the balancing member may be arranged at a distance from the boom, e.g. in a rear portion of an excavator. In the present context, "indirectly and force-transmittingly coupling" means that there is no direct attachment of the balancing member on the boom as would be the case where an element of the balancing member is directly coupled to the boom by means of a pivot pin. Stated differently, a force generated by the balancing member is transferred to the boom by at least one intermediate member which does not have an additional function besides transferring the force from the balancing member to the boom.

According to a further preferable embodiment of the present disclosure, the force transfer mechanism comprises a flexible link, preferably a wire rope or chain.

By using a flexible link, it is possible to transfer forces on suitable paths allowing for a greater freedom of design. Furthermore, using a flexible link is optimum for transferring tensile forces while allowing lightweight constructions. Moreover, such force transfer mechanisms are easy to maintain. The flexible link may be deflected by means of one or more pulleys provided in the force transfer mechanism.

According to a further preferable embodiment of the present disclosure, the balancing member is coupled to the flexible link at a coupling portion of the flexible link, preferably in such a manner that a direction of a force generated by the balancing member is aligned or parallel with an extension direction of the flexible link in the coupling portion.

Thus, in a preferable construction, a force generated by the balancing member may be linearly transferred to the flexible link which is beneficial as no forces a created on the balancing member in a direction which differs from the force generation direction. In this manner, the durability of the mechanism is enhanced.

According to a further preferable embodiment of the present disclosure, the force transfer mechanism comprises a transmission.

In the context of the present disclosure, a transmission is to be understood as a device or mechanism which is able to convert an input force to a different output force and thus having a transmission ratio different from one. A transmission may be realized as a constant or a variable transmission which means that the transmission may comprise a fixed transmission ratio or a variable transmission ratio. Since the force transfer mechanism comprises a transmission, the force created by the balancing member can be converted to a suitable force needed for a specific configuration while keeping the size of the balancing member at an appropriate dimension. Thus, using a transmission allows for a more compact and cost-efficient configuration.

According to a further preferable embodiment of the present disclosure, the transmission comprises a cone-shaped pulley and the flexible link is guided around the cone-shaped pulley in an axially offset manner. In this way, a reliable and easy to manufacture transmission is provided.

The flexible link, e.g. a wire rope, can be guided around such a pulley in a helical manner. In the context of the present disclosure, axially offset manner is to be understood in such a way that an initial contact between the flexible link and the cone-shaped pulley is made at a first portion of the pulley and a disengagement of the flexible link from the cone-shaped pulley is made at a second portion of the pulley wherein the first portion and the second portion are provided at different axial positions of the cone-shaped pulley. For example, the pulley can have the shape of a truncated cone.

According to a further preferable embodiment of the present disclosure, the force transfer mechanism comprises a coupling device for transferring a force from the flexible link to the boom such that an assisting moment assisting said movement of the boom is generated on the boom.

The coupling device may be any device which is able to transfer a force from the flexible link to the boom such that an assisting moment is generated on the boom. For example, the coupling device may comprise a disc shape and can be mounted to the boom integrally movable with the same. The flexible link may be mounted to and guided on a peripheral edge surface. In this way, a simple and reliable coupling device is provided rendering the overall excavator more cost-efficient.

According to a further preferable embodiment of the present disclosure, the coupling device is structured such that a force introduced into the coupling device by the flexible link is transferred to the boom at a fixed ratio independent from the position of the boom. In this way, the force applied to the boom is constant over the entire movement of the boom.

According to a further preferable embodiment of the present disclosure, the coupling device is structured such that a force introduced into the coupling device by the flexible link is transferred to the boom with a varying ratio, the varying ratio changing according to the position of the boom. Accordingly, a varying transmission ratio can be provided which can be adapted to the position of the boom in the movement range of the boom and thus be adapted to a moment.

According to a further preferable embodiment of the present disclosure, the coupling device comprises a force transfer device fixedly coupled to the boom such that the force transfer device and the boom are integrally movable, wherein the force transfer device comprises a peripheral surface for guiding the flexible link at a predetermined distance from a hinge portion at which the boom is articulated, and wherein the flexible link is coupled to the force transfer device such that a portion of the flexible link contacts a predetermined section of the peripheral surface when the boom is in a lower position.

According to a further preferable embodiment of the present disclosure, the peripheral surface is at least partially curved and preferably at least partially comprises the shape of a circular arc.

According to a further preferable embodiment of the present disclosure, a center axis of the force transfer device is aligned with a rotational axis of the boom in the hinge portion.

According to a further preferable embodiment of the present disclosure, the balancing member is a counter weight.

According to a further preferable embodiment of the present disclosure, the balancing member is a pressure cylinder.

According to a further preferable embodiment of the present disclosure, the force transfer mechanism comprises rigid links.

Additional features and advantages may be gleaned by the person skilled in the art from the following description of exemplary embodiments, which are not to be construed as limiting, however, drawing reference to the attached drawings.

BRIEF DESCRIPTION OF THE DRAWINGS

The present invention will hereinafter be described in conjunction with the following drawing figures, wherein like numerals denote like elements, and:

FIG. 4A shows a side view of an excavator according to a further embodiment of the present disclose and FIGS. 4B and 4C show different views of a pulley of a transmission of the excavator shown in FIG. 4A.

All figures are only schematic depictions of exemplary embodiments in which, in particular, distances and dimensional correlations are not presented to scale.

DETAILED DESCRIPTION

The following detailed description is merely exemplary in nature and is not intended to limit application and uses. Furthermore, there is no intention to be bound by any theory presented in the preceding background or summary or the following detailed description.

Figure 1:
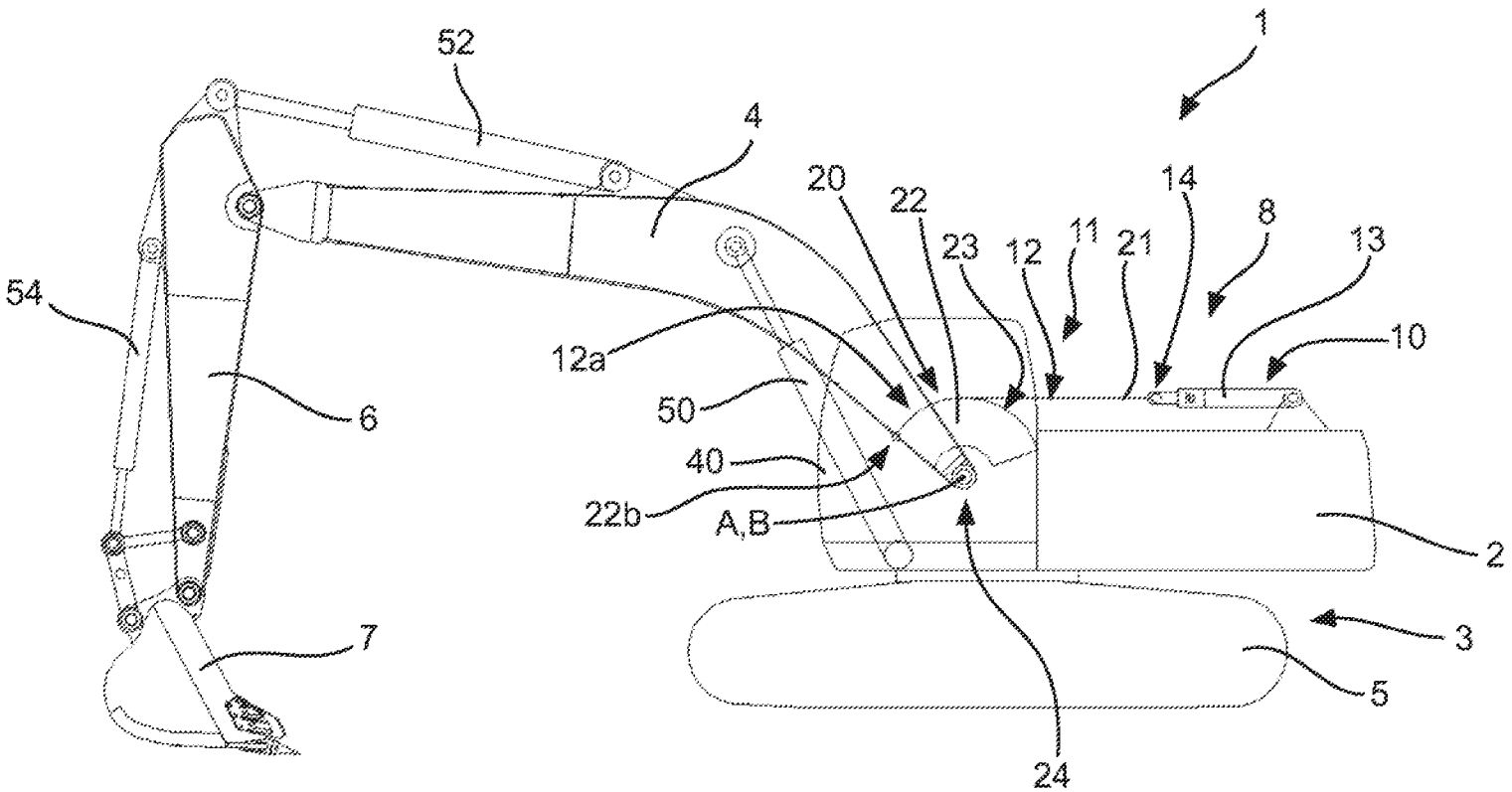
FIGS. 1-3 show different embodiments of excavators according to the present disclosure.

FIG. 1 shows a side view of an excavator 1 according to an embodiment of the present disclosure. The excavator 1 comprises a platform 2, also called top frame, which is rotatably coupled to an undercarriage 3 having tracks 5. On the platform 2, a boom 4 is hingedly mounted at a hinge portion 24, i.e. at a first end of the boom 4, and an operator's cab 40 is provided. The boom 4 is rotatable about a rotation axis A. A dipper 6, also called stick or bucket arm, is hingedly coupled to the boom 4. A bucket 7 is hingedly coupled to the dipper 6. The boom 4 is movable by means of a first hydraulic cylinder 50 supported on the platform 2 and coupled to the boom, the dipper 6 is movable by means of a second hydraulic cylinder 52 supported on the boom and connected to the dipper, and the bucket is movable by means of a third hydraulic cylinder 54 supported on the dipper and coupled to the bucket 7. It is to be noted, that although only one first cylinder 50 is shown in FIG. 1, it is possible to use two hydraulic cylinders 50, one on each side of the boom 4. In the configuration as shown, the hydraulic cylinder 50 exerts a pushing force on the boom 4 in order to move the same. Inside the platform 2, a motor (not shown) is provided for generating power used for moving the excavator and for actuating the hydraulic cylinders 50, 52, 54.

In order to assist the boom 4, and consequently the cylinders 50 in moving the boom from a lower position to an upper position, the excavator 1 further comprises a balancing mechanism 8 which is configured to apply a pulling force on the boom 4. In this way, less power has to be applied on the boom 4 by the first hydraulic cylinder 50 in order to move the boom 4 allowing to use smaller hydraulic cylinders. Furthermore, as a pulling force is applied on the boom 4 by means of the balancing mechanism, the response characteristics are enhanced because the force necessary for moving the boom 4 can be generated faster in the first hydraulic cylinder 50.

Figure 2:
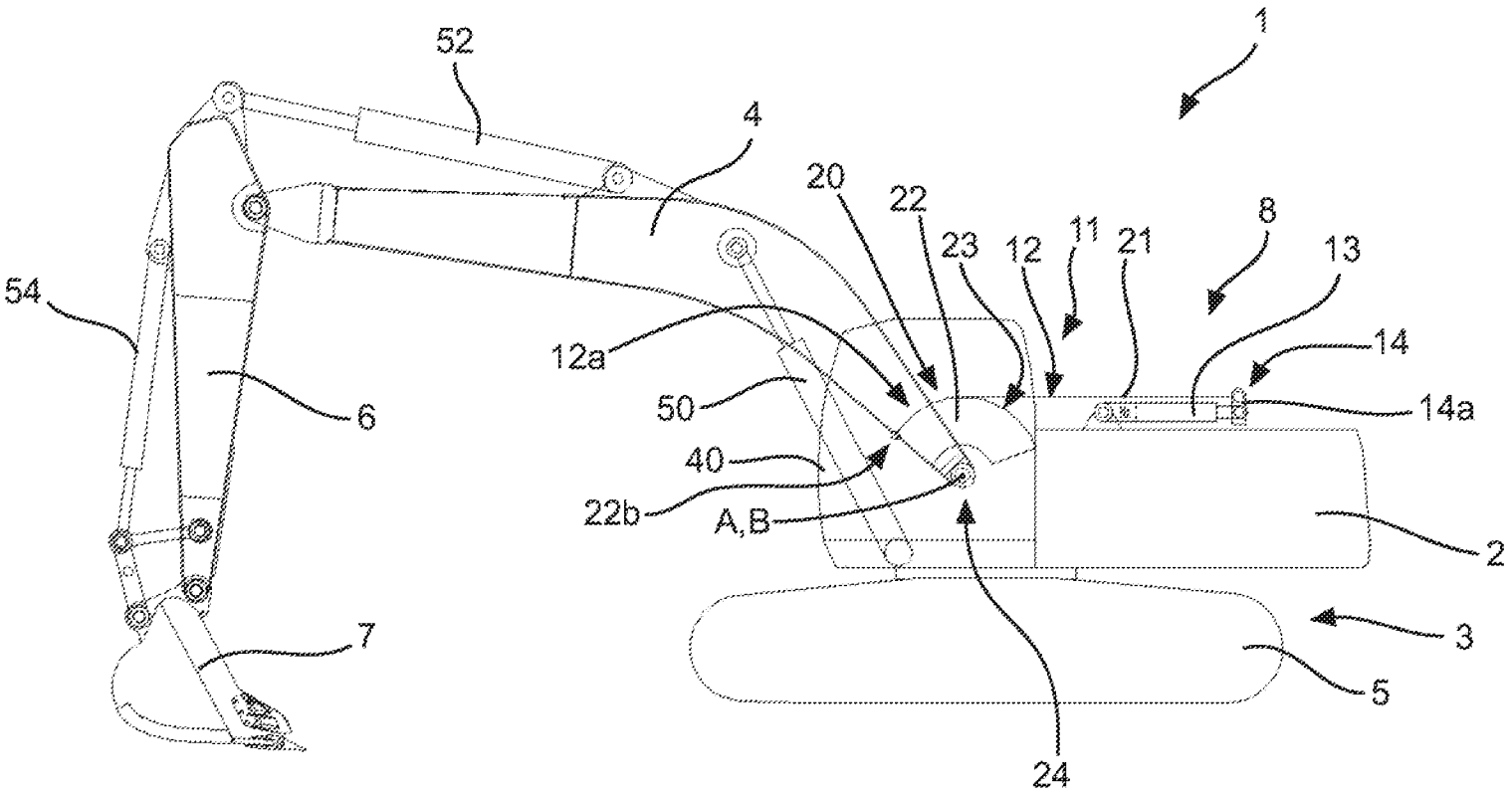

The balancing mechanism 8 as shown in FIG. 2 comprises a balancing member 10 for generating an assisting force and a force transfer mechanism a for transferring the force generated by the balancing member 10 to the boom 4. In the present embodiment, the balancing member 10 is a pressure cylinder 13 comprising nitrogen as pressure gas and is mounted to the platform 2 at one end and coupled to the force transfer mechanism 11 at the other end. Here, it is to be noted that the general construction of the excavator as described so far also applies for all embodiments other than the one described with respect to FIG. 1.

The force transfer mechanism as shown in FIG. 1 comprises a flexible link 12 which in this embodiment is a wire rope 21. However, a chain (not shown) could also be used instead of the wire rope 21. The wire rope 21 is at one end coupled to the pressure cylinder 13 at a coupling portion 14 in such a manner that a direction of a force generated by the pressure cylinder 13 is aligned with an extension direction of the wire rope 21. At the other end, the wire rope 21 is coupled to a coupling device 20 which is configured to transfer a force from the wire rope 21 to the boom 4 such that an assisting moment assisting the movement of the boom 4 is generated on said boom 4.

The coupling device 20 is structured such that a force introduced into the coupling device 20 by the wire rope 21 is transferred to the boom 4 at a fixed ratio independent from the position of the boom 4. For that, the coupling device 20 comprises a force transfer device 22 fixedly coupled to the boom 4 such that the force transfer device 22 and the boom are integrally movable. For example, the force transfer device 22 can be welded to the boom 4 or may be fixedly attached by means of threaded bolts or screws. The force transfer device 22 comprises a peripheral surface 23 for guiding the wire rope 21 at a predetermined distance from hinge portion 24 at which the boom 4 is articulated.

In the present embodiment, the peripheral surface 23 of the force transfer device 22 follows a circular path having its center on center axis A. Center axis A is aligned with rotational axis B of the boom 4 in the hinge portion 24. The wire rope 21 is coupled to the force transfer device 22 at a fixation portion 22*b* thereof, i.e. in FIG. 1 on the left side peripheral surface end of the force transfer device 22, such that a portion 12*a* of the wire rope 21 contacts a predetermined section of the peripheral surface 23 when the boom 4 is in the position as shown in FIG. 1. This position of the boom as shown can also be referred to as lower position. Accordingly, when the boom is moved in the counterclockwise direction, the dimension of the portion 12*a* will increase whereas when the boom 4 is moved in the clockwise direction, the wire rope 21 will unwound from the force transfer device so that the dimension of the portion 12*a* will decrease. Since the peripheral surface follows a circular path about the hinge axis A, a force transferred on the force transfer device 22 is always converted into torque acting on the boom 4 with the same ratio. In other words, if the force generated by the pressure cylinder 13 is constant over the entire movement area of the boom 4, a corresponding constant torque will be generated on the boom 4.

FIG. 2 shows a configuration of an excavator 1 which differs from the configuration as shown in FIG. 1 in that the pressure cylinder 13 is arranged inversely. In this configuration, the rear end of the pressure cylinder 13, which is supported against the platform 2 faces the boom 4 and the coupling portion 14 is located on the right side in FIG. 2. In this embodiment, the coupling portion 14 comprises a link 14*a* which allows a coupling of the wire rope 21 at a position which is laterally offset with respect to the pressure cylinder 13. In this configuration, the wire rope 13 extends along and parallel to the pressure cylinder 13.

Figure 3:
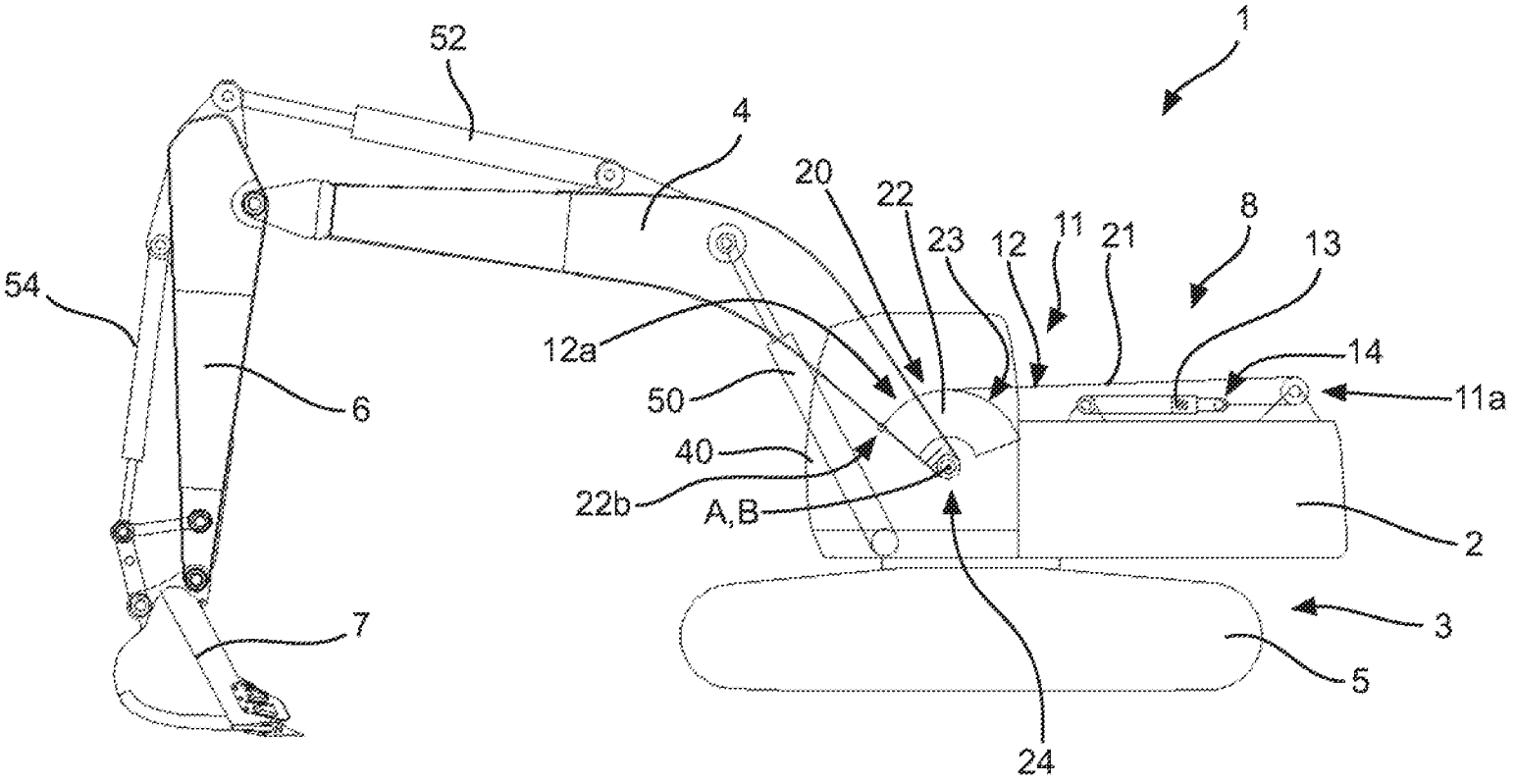

FIG. 3 shows a configuration of an excavator 1 which differs from the configuration as shown in FIG. 1 in that the pressure cylinder 13 is arranged inversely similar to the embodiment shown in FIG. 2. However, in the embodiment of FIG. 3, the force transfer mechanism 11 comprises a deflection pulley 11*a* which deflects the wire rope 21, about 180° in the example as shown. With this configuration, the direction of a pulling force exerted on the pressure cylinder is independent from a dimension of the force transfer device 22. In this embodiment, the pressure cylinder extends substantially horizontally and this will not change even if a differently shaped force transfer device 22 is used.

Figure 4A:
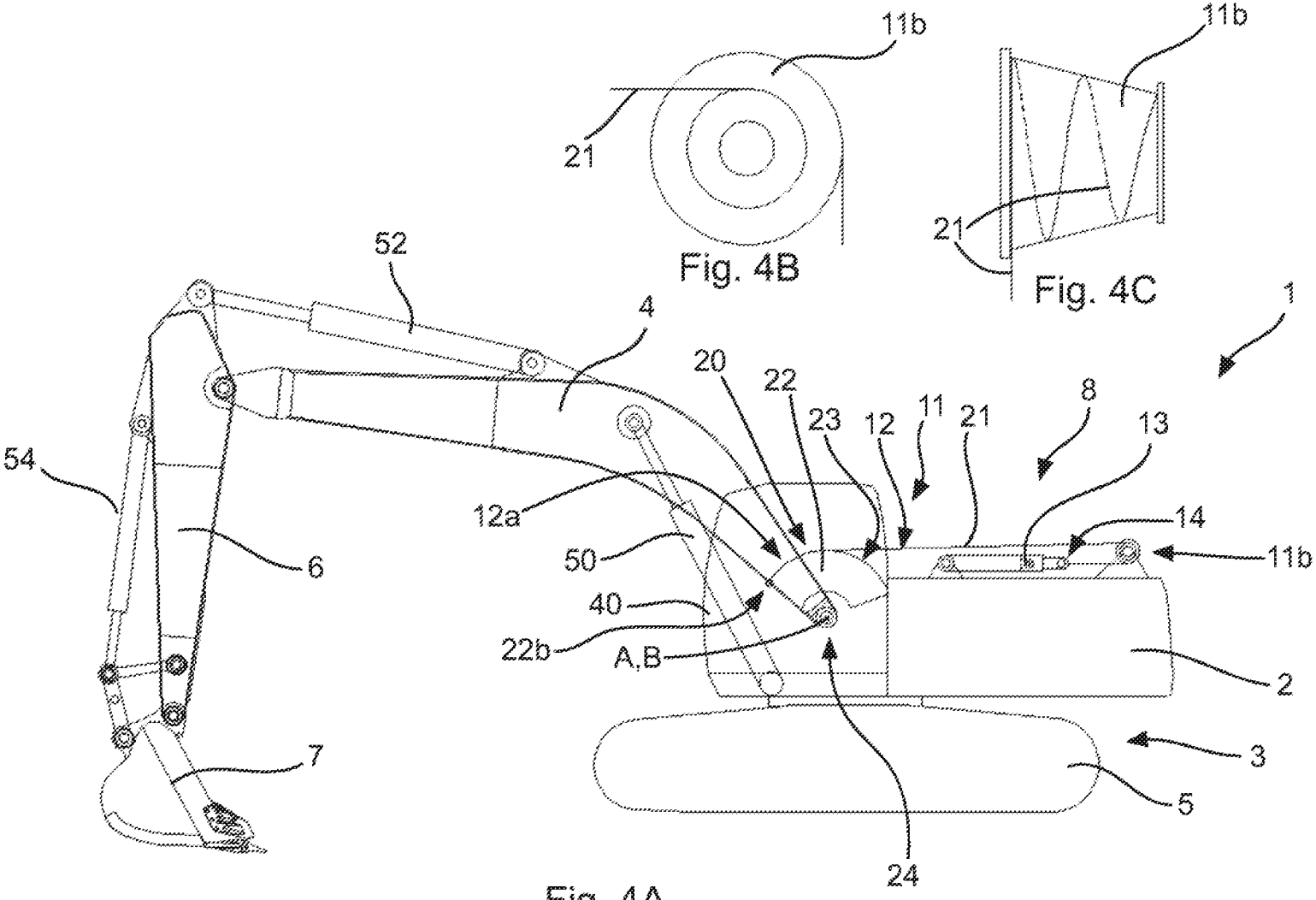

FIG. 4A shows a configuration of an excavator 1 according to a further embodiment which differs from the configuration as shown in FIG. 3 in that the force transfer mechanism 11 comprises a transmission realized by a cone-shaped pulley 11*b*, i.e. a pulley shaped in the form of a truncated cone, instead of the deflection pulley 11*a* as shown in FIG. 3. In this embodiment, the transmission is generated by means of a diameter difference of between pulley surface portions where a contact of the wire rope 21 with the pulley is established or released. In the embodiment as shown in FIG. 4A, these pulley surface portions are provided on the left and right end of the conical surface of the cone-shaped pulley 11*b* as shown in FIGS. 4B and 4C. In the embodiment of FIG. 4A, the wire rope 21 coming from the pressure cylinder 13 makes contact with the surface of the cone-shaped pulley 11*b* on the left side in FIG. 4C, i.e. at a portion of the pulley having the greatest diameter. The wire rope 21 is then wound about the outer surface of the pulley multiple times and leaves the pulley surface at a portion having smallest diameter. In this way, the output force on the wire rope 21 is increased by the pulley. Thus, the cone-shaped pulley 11*b* provides a reliable and cost-efficient transmission.

Figure 5:
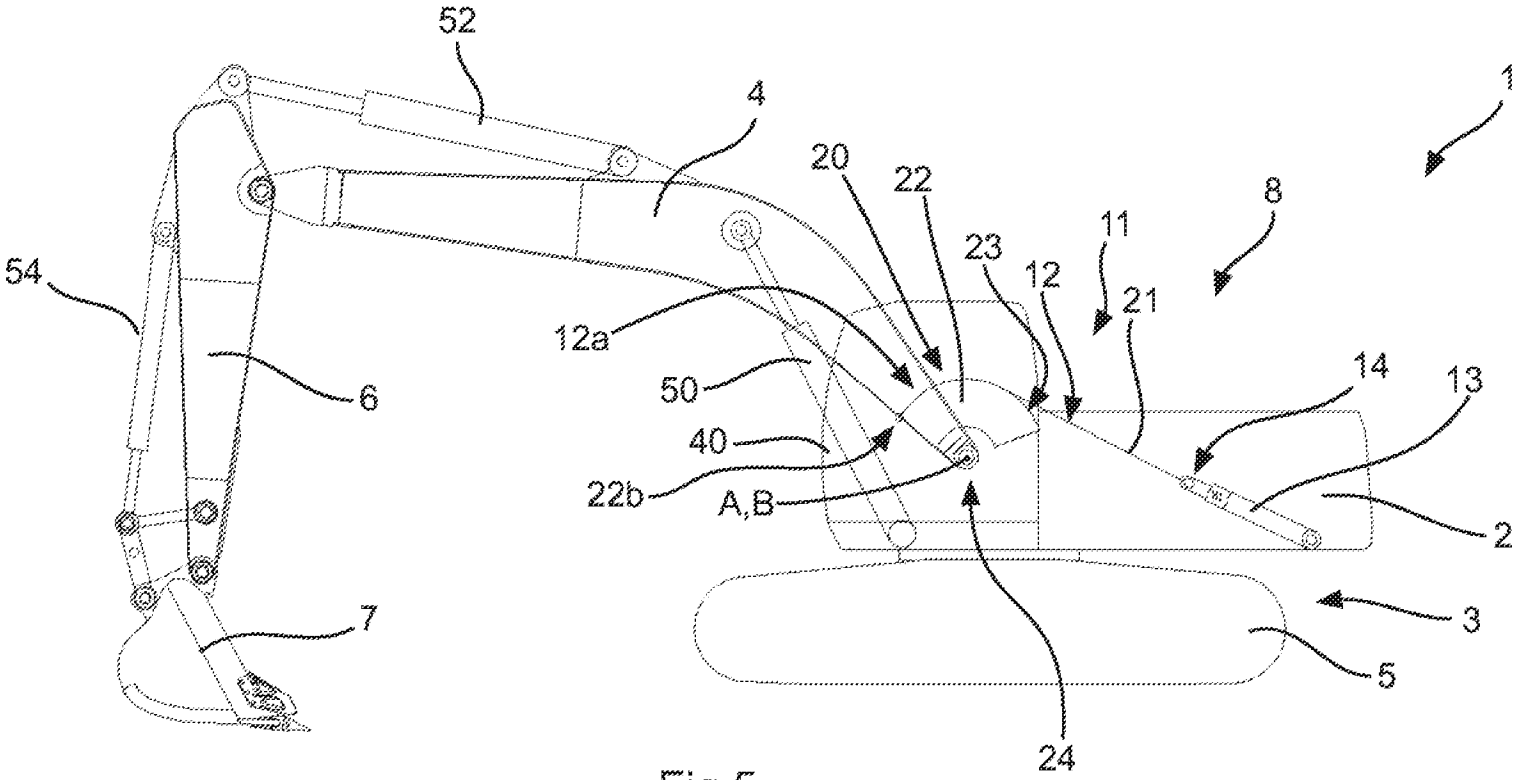
FIGS. 5-26 show different further embodiments of excavators according to the present disclosure.

FIG. 5 shows a configuration of an excavator 1 according to a further embodiment which differs from the configuration as shown in FIG. 1 only in that the pressure cylinder 13 is coupled to a lower portion of the platform 2 so that a larger portion 12*a* of the wire rope 21 which can contact a predetermined section of the peripheral surface 23 is available. With this configuration, an assisting range is increased.

Figure 6:
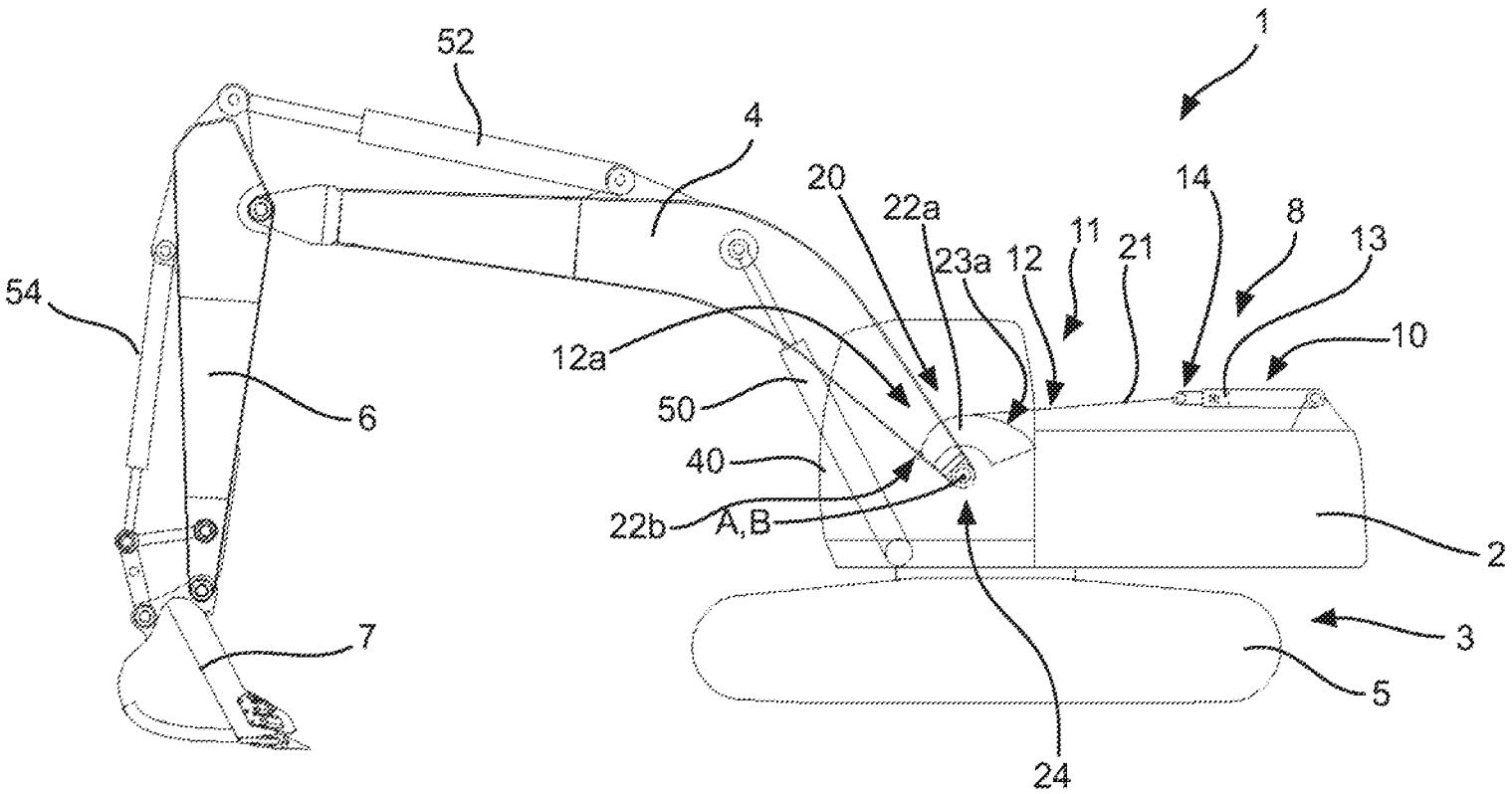

FIG. 6 shows a configuration of an excavator 1 according to a further embodiment which differs from the configuration as shown in FIG. 1 only in the construction of the coupling device 20. The coupling device 20 is structured such that a force introduced into the coupling device 20 by the wire rope 21 is transferred to the boom 4 at a variable ratio dependent on the position of the boom 4. For that, the coupling device 20 comprises a force transfer device 22*a* fixedly coupled to the boom 4 such that the force transfer device 22*a* and the boom 4 are integrally movable. The force transfer device 22*a* comprises a peripheral surface 23*a* which comprises a contour defined by a path extending about center axis A while a radial distance with respect to the axis A increases when following the path in clockwise direction in FIG. 5. With increasing radial distance from axis A a moment is correspondingly increased. With the configuration as shown in FIG. 5, the force transfer device 22*a* is structured such that a force introduced into the force transfer device 22*a* by the wire rope 21 generates a maximum torque when the boom is rotated to the lowest position. When the boom 4 is rotated in the clockwise direction, the point at which force from the wire rope 21 is introduced into the force transfer device 22*a* moves towards axes A, B so that a distance for torque generation is reduced. Accordingly, the transmission ratio varies with the movement of the boom 4.

Figure 7:
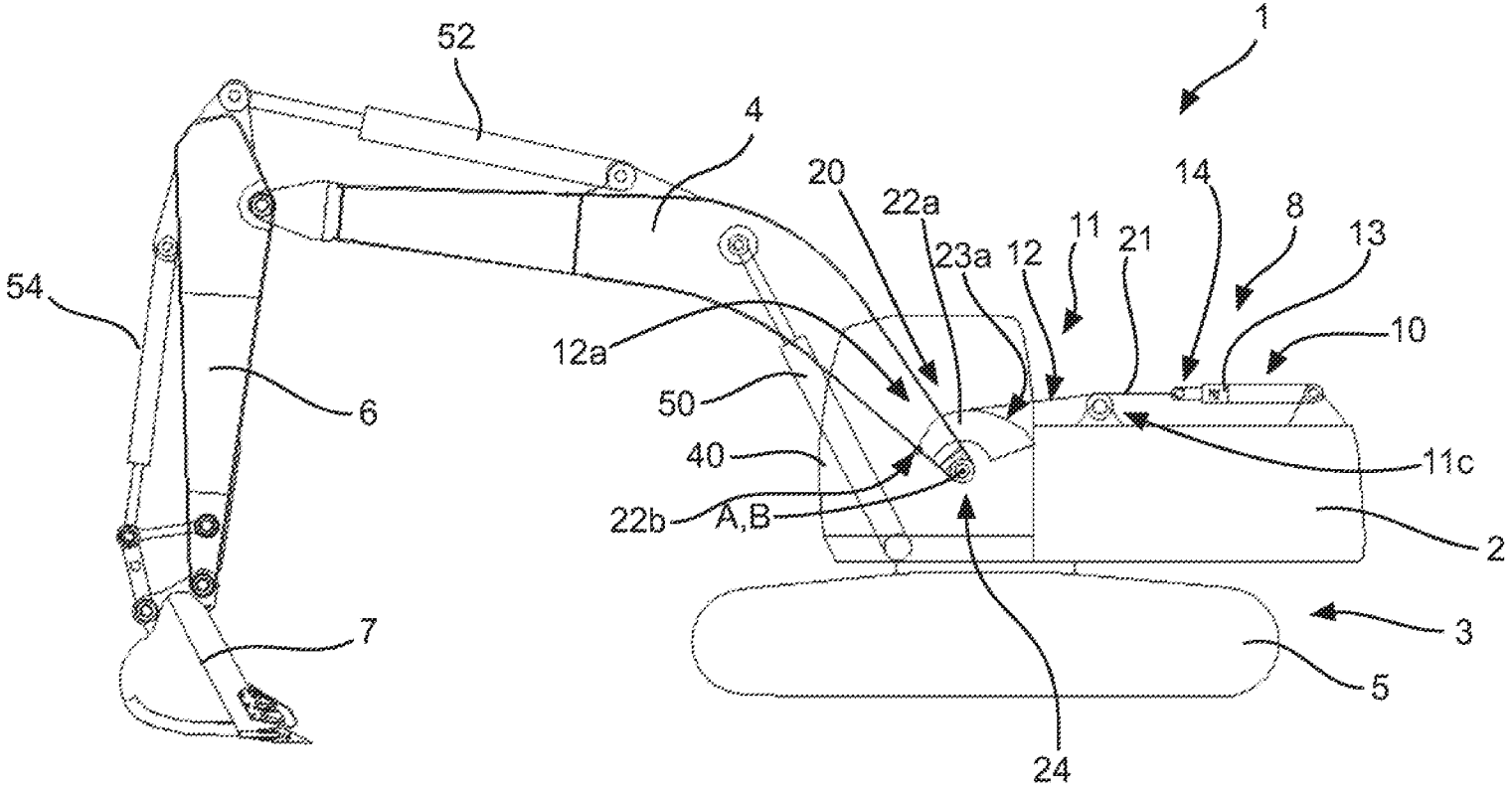

FIG. 7 shows a configuration of an excavator 1 according to a further embodiment which differs from the configuration as shown in FIG. 6 only in that the force transfer mechanism 11 comprises a deflection pulley 11*c* which is arranged between the pressure cylinder 13 and the coupling device 20. By using the deflection pulley 11*c*, a force transferred via coupling portion 14 is always transferred in the same direction, which in the embodiment as shown is a substantially horizontal direction.

Figure 8:
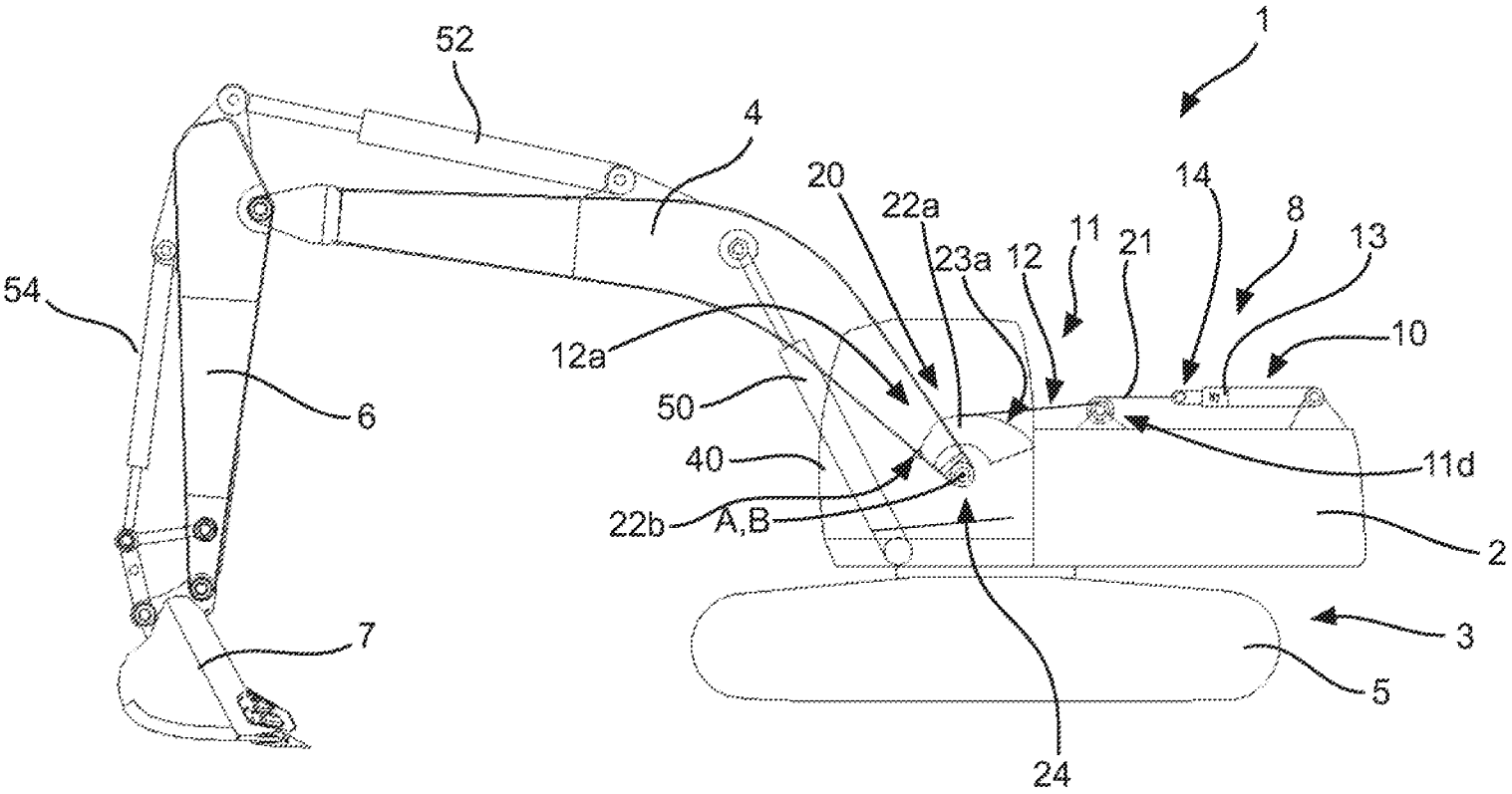

FIG. 8 shows a configuration of an excavator 1 according to a further embodiment which differs from the configuration as shown in FIG. 7 only in that the force transfer mechanism 11 comprises a deflection pulley 11*d* which is configured like the cone-shaped pulley 11*b* as shown in FIGS. 4A, 4B and 4C. Thus, deflection pulley 11*d* additionally comprises transmission capabilities as described above with respect to the embodiment as shown in FIGS. 4A, 4B and 4C.

Figure 9:
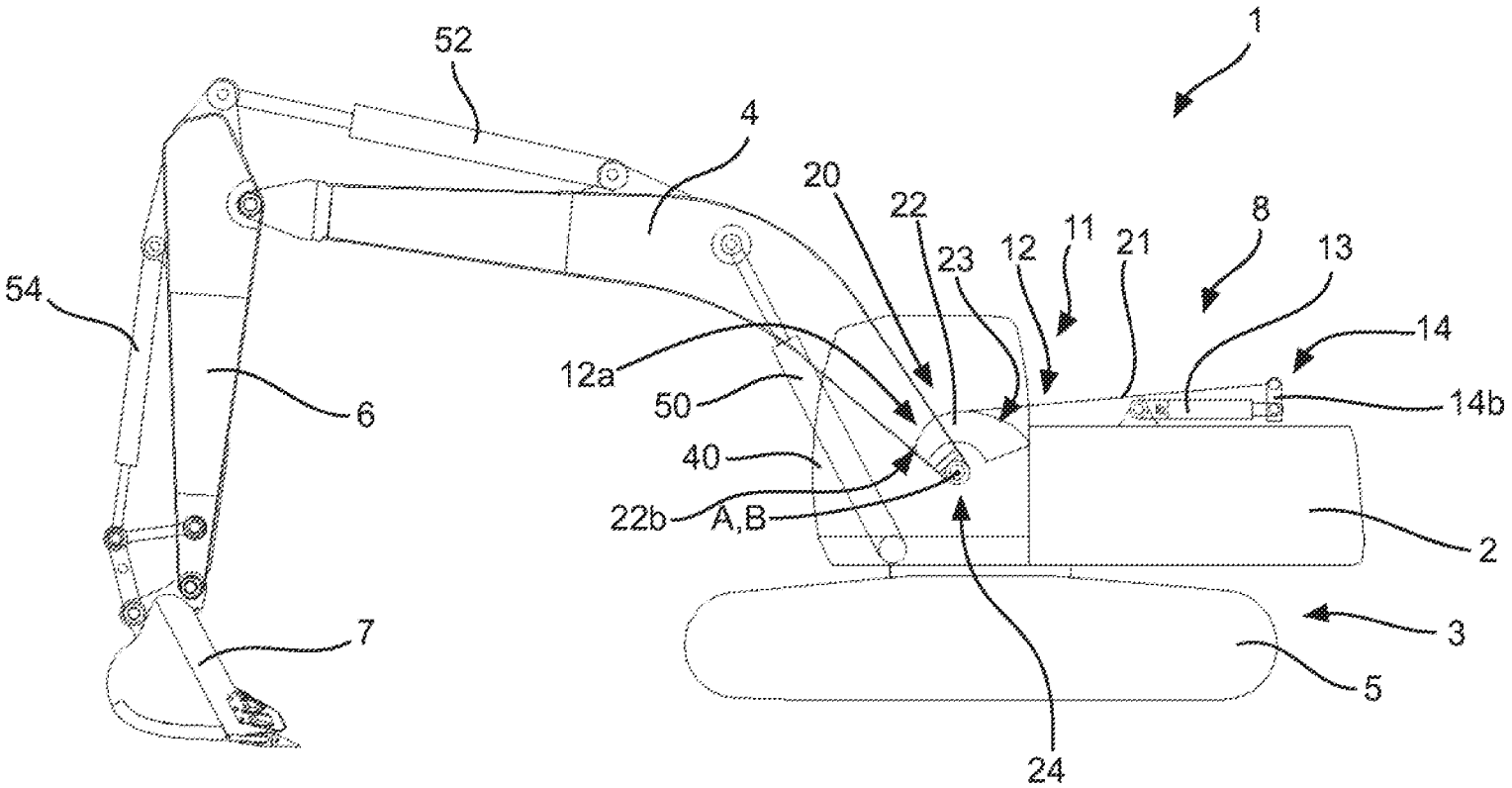

FIG. 9 shows a configuration of an excavator 1 according to a further embodiment which differs from the configuration as shown in FIG. 2 only in that coupling device 20 is structured as described in connection with the embodiment as shown in FIG. 5.

Figure 10:
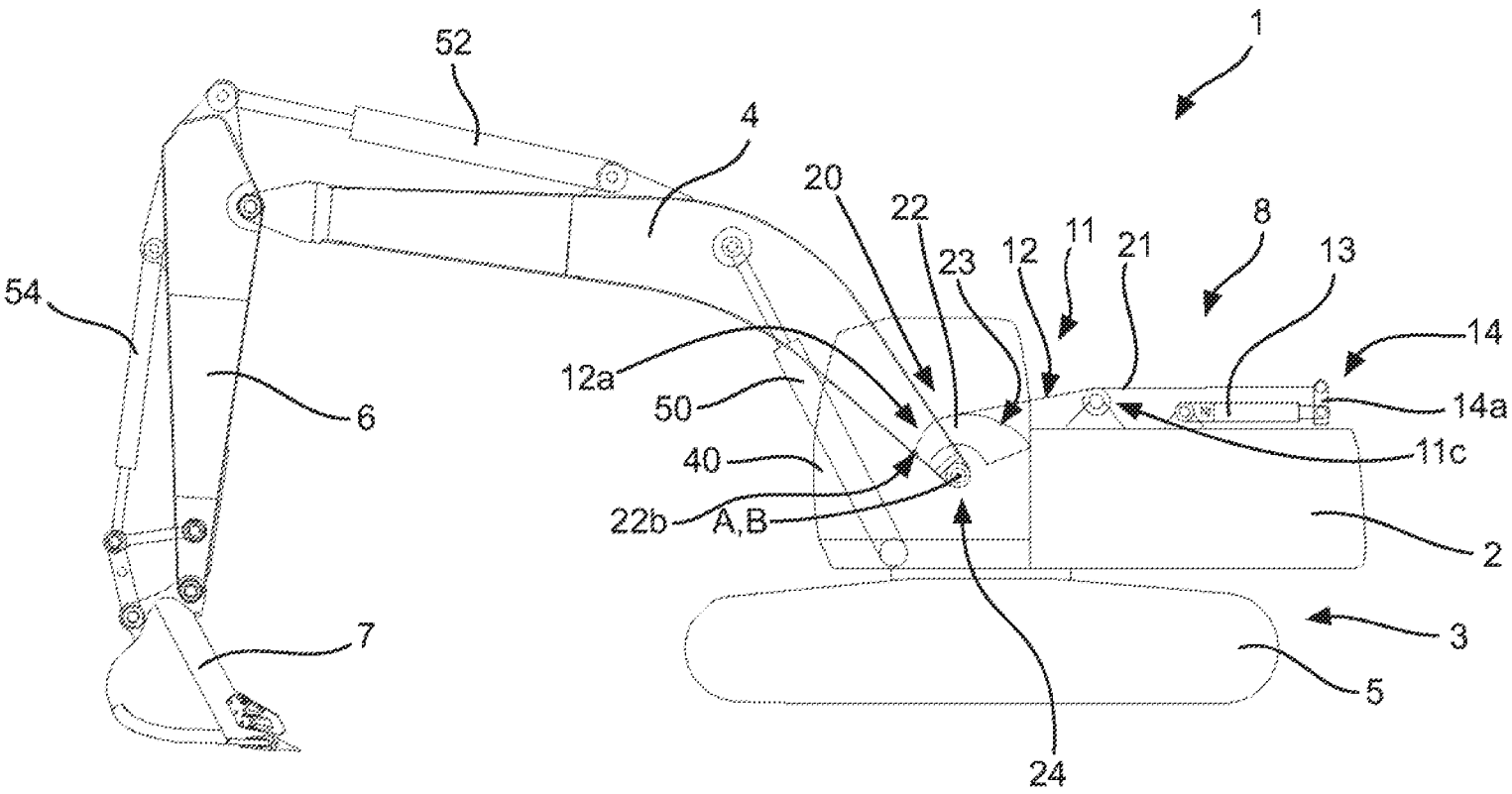

FIG. 10 shows a configuration of an excavator 1 according to a further embodiment which differs from the configuration as shown in FIG. 7 in that the pressure cylinder is inversely arranged in a manner as described with respect to the embodiment as shown in FIG. 2.

Figure 11:
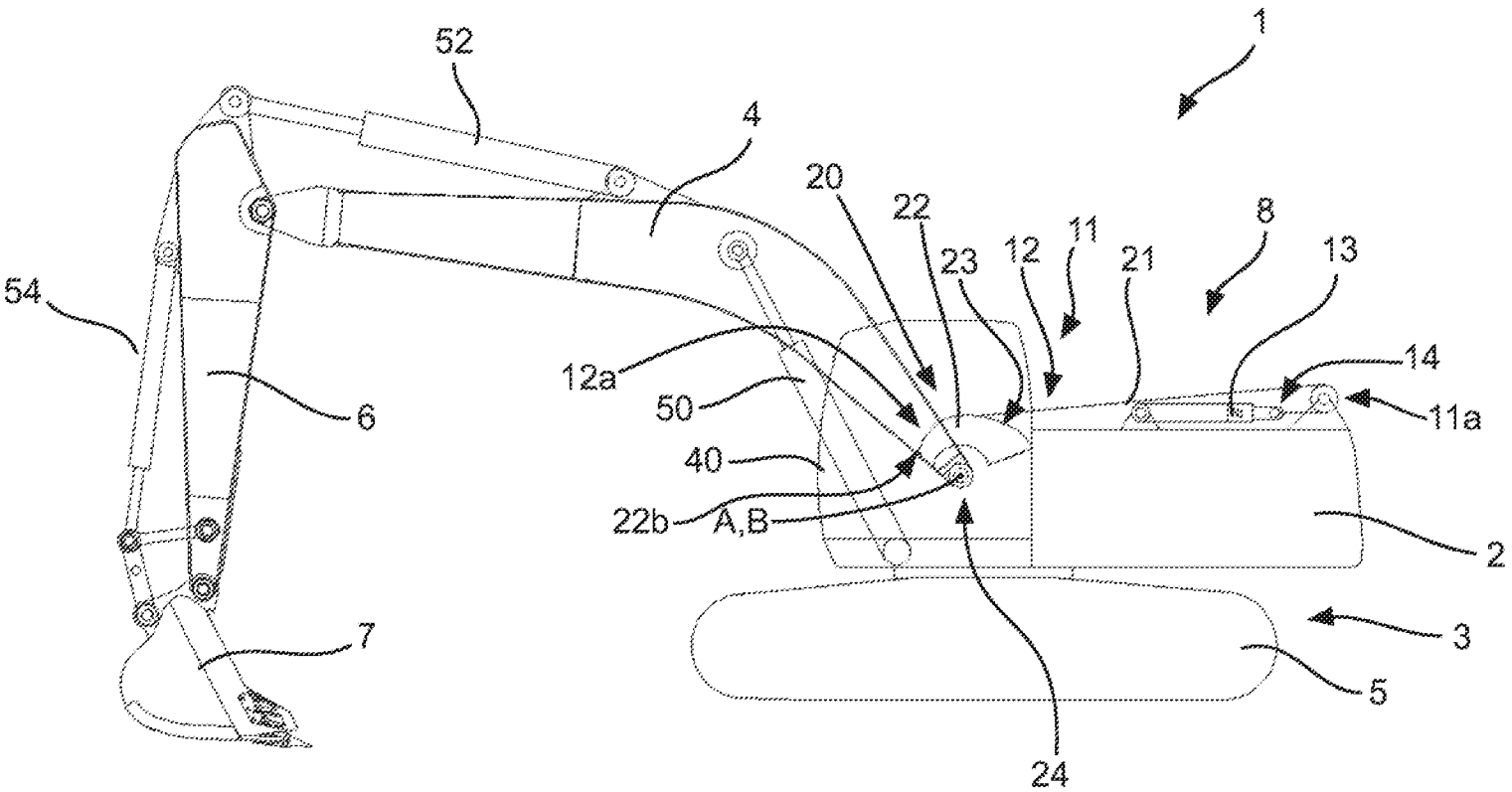

FIG. 11 shows a configuration of an excavator 1 according to a further embodiment which differs from the configuration as shown in FIG. 3 only in that coupling device 20 is structured as described in connection with the embodiment as shown in FIG. 5.

Figure 12:
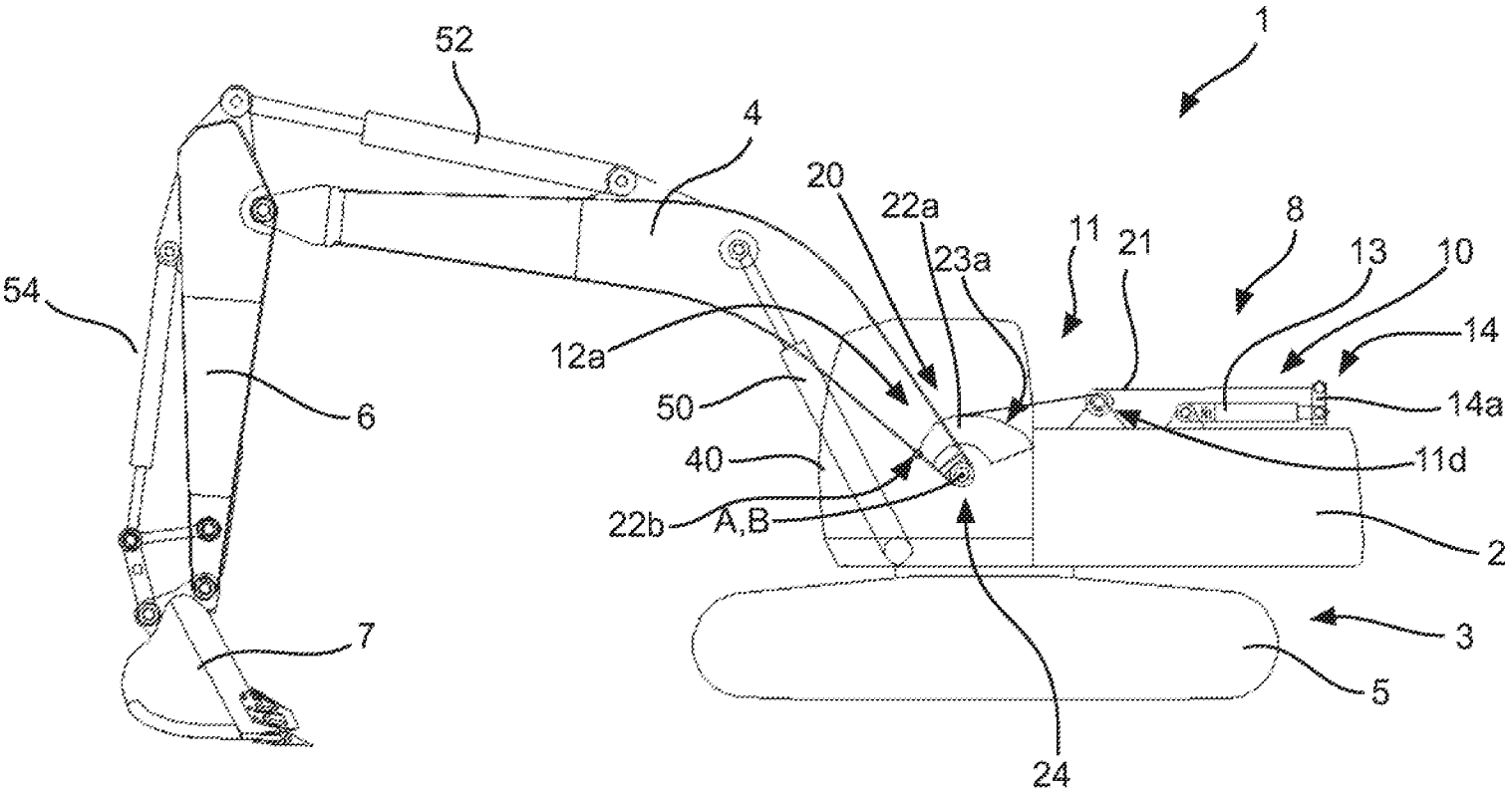

FIG. 12 shows a configuration of an excavator 1 according to a further embodiment which differs from the configuration as shown in FIG. 8 only in that the pressure cylinder is inversely arranged in a manner as described with respect to the embodiment as shown in FIG. 2.

Figure 13:
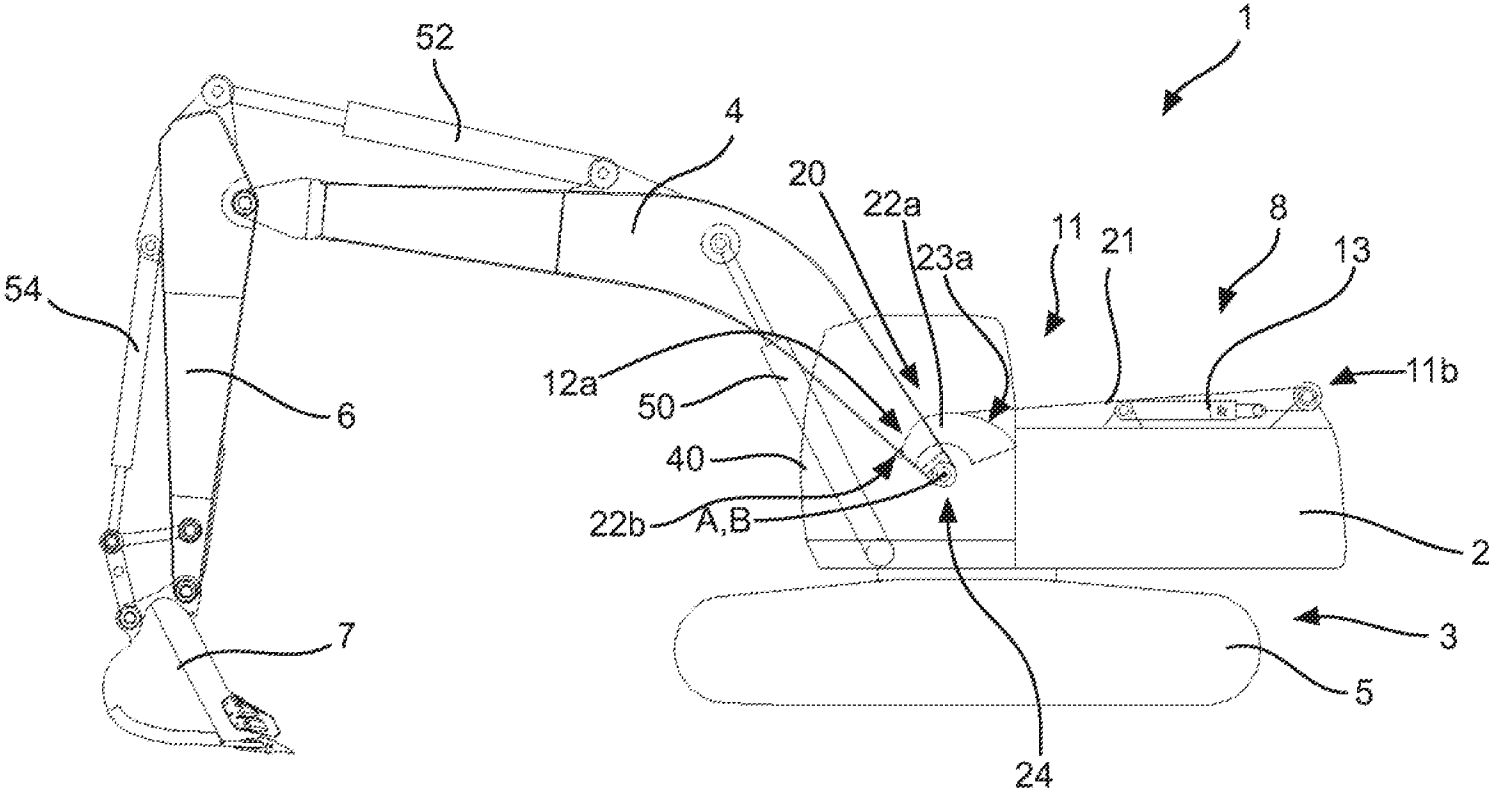

FIG. 13 shows a configuration of an excavator 1 according to a further embodiment which differs from the configuration as shown in FIG. 4 only in that coupling device 20 is structured as described in connection with the embodiment as shown in FIG. 6.

Figure 14:
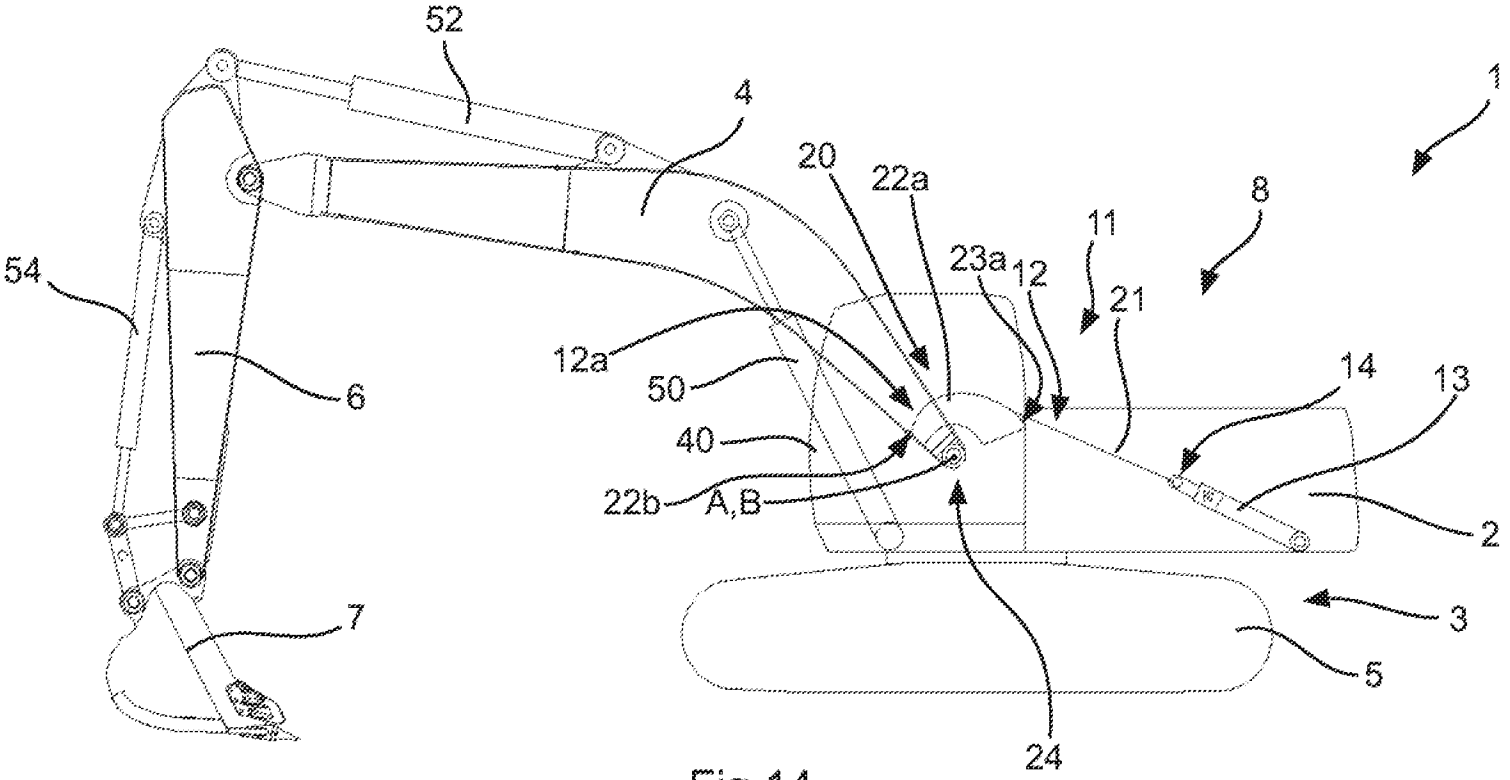

FIG. 14 shows a configuration of an excavator 1 according to a further embodiment which differs from the configuration as shown in FIG. 5 only in that coupling device 20 is structured as described in connection with the embodiment as shown in FIG. 6.

Figure 15:
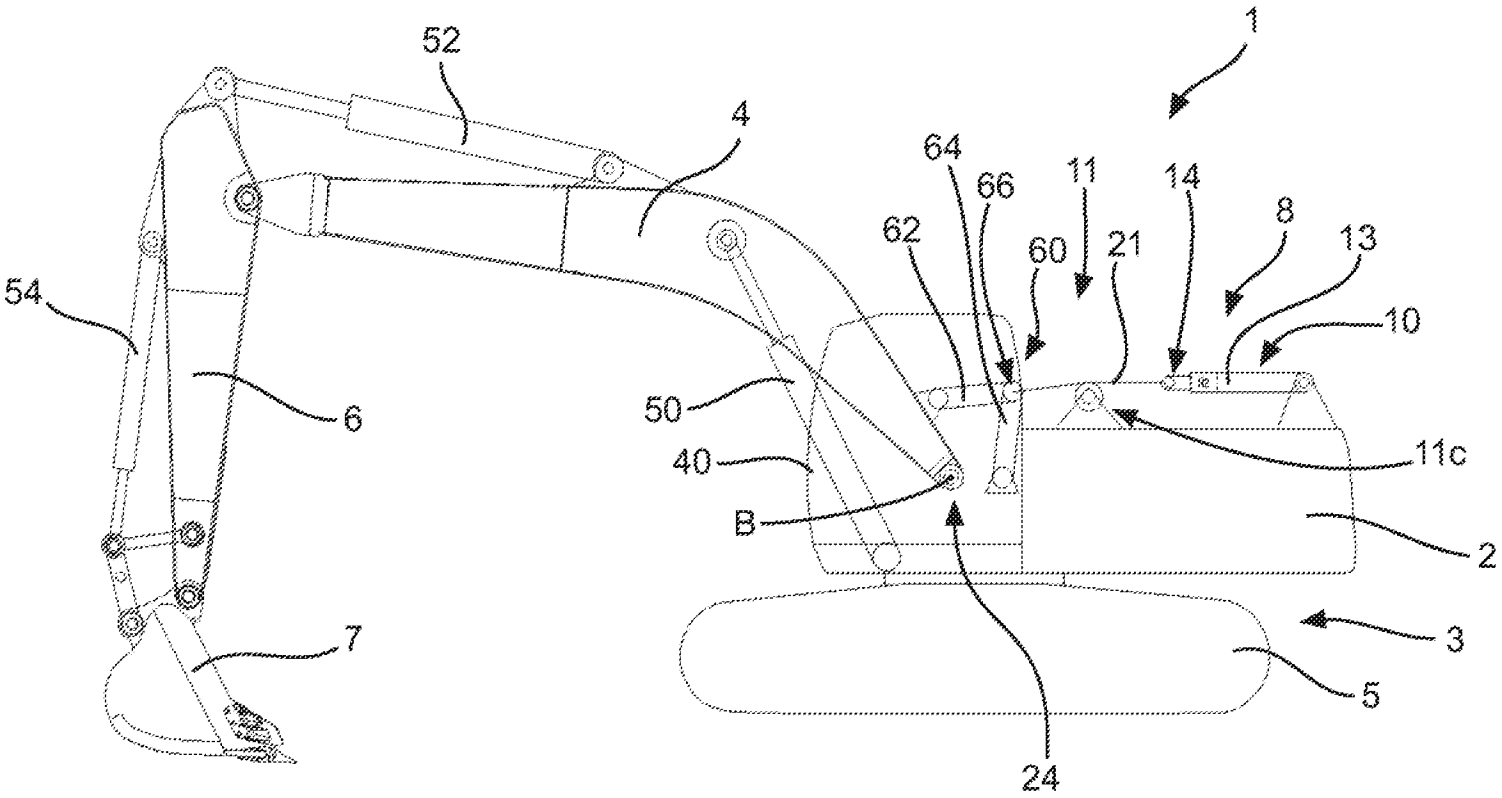
Figure 16:
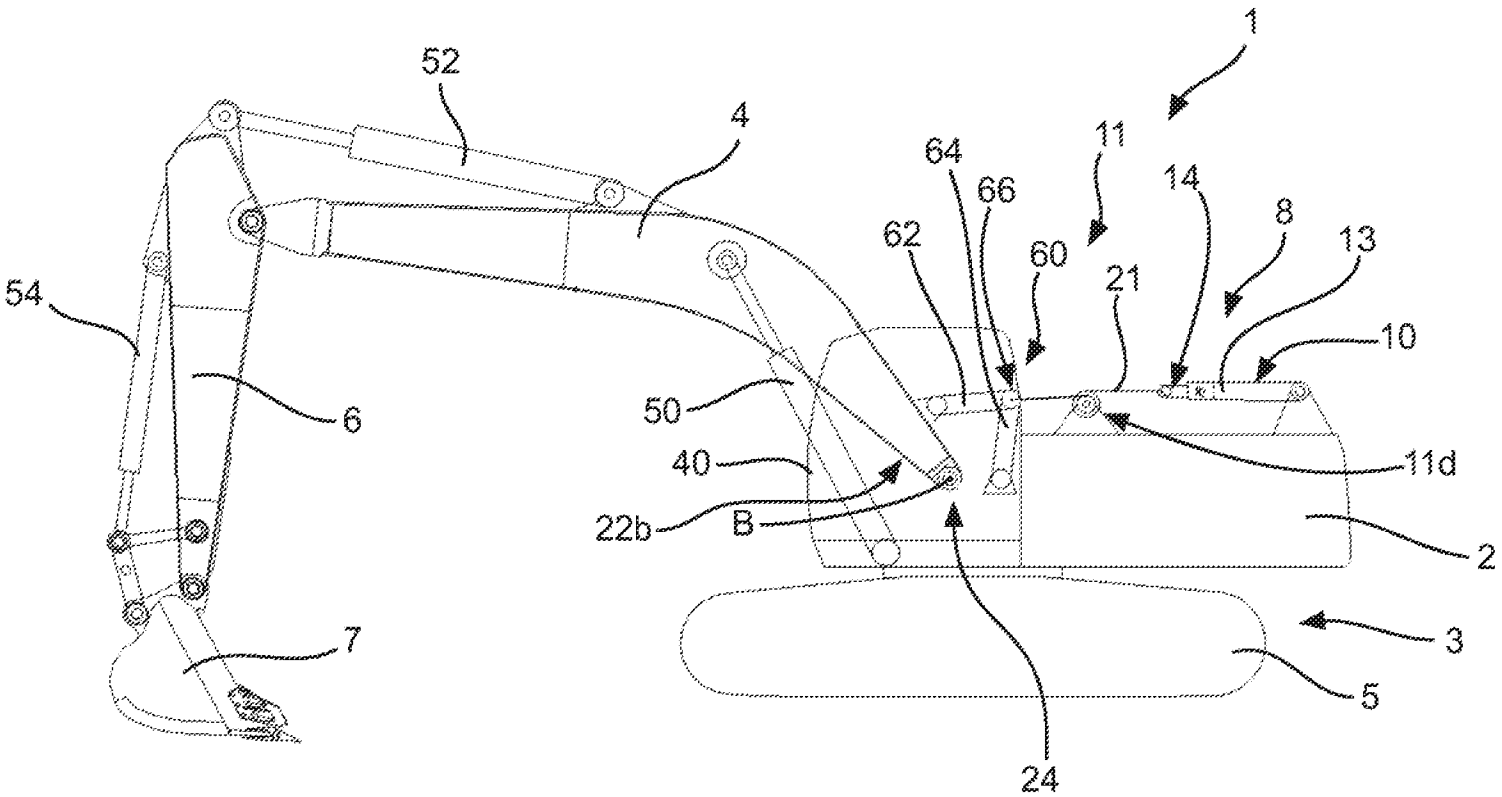

FIG. 15 shows a configuration of an excavator 1 according to a further embodiment which differs from the configuration as shown in FIG. 7 only in that instead of coupling device 20 a link mechanism 60 is used for transferring a force introduced into the link mechanism 60 by the wire rope 21 is transferred to the boom 4 at a fixed ratio independent from the position of the boom 4. For that, the link mechanism 60 comprises a rigid force transfer link 62 connected to the end of the wire rope 21 at a connecting portion 66 and hingedly coupled to the boom 4 at the other end thereof and a rigid guiding link 64 coupled to the connecting portion 66 between wire rope 21 and force transfer link 62 at one end and hingedly coupled to the platform 2 at the other end. Accordingly, FIG. 16 shows a configuration of an excavator 1 according to a further embodiment which differs from the configuration as shown in FIG. 8 only in that instead of coupling device 20 a link mechanism 60 according to the embodiment as shown in FIG. 15 is used.

Figure 17:
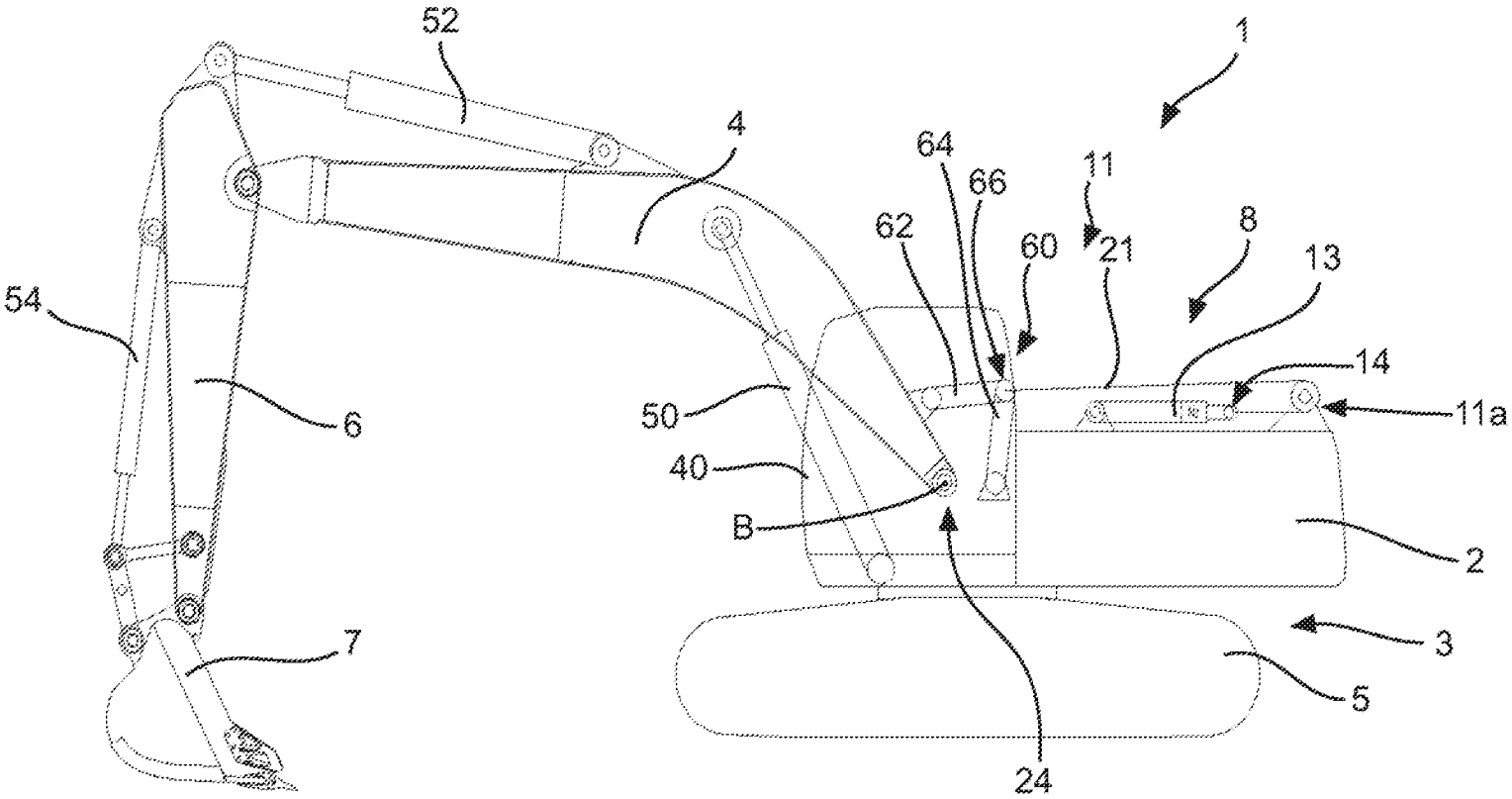

FIG. 17 shows a configuration of an excavator 1 according to a further embodiment which differs from the configuration as shown in FIG. 3 only in that instead of coupling device 20 a link mechanism 60 according to the embodiment as shown in FIG. 15 is used.

Figure 18:
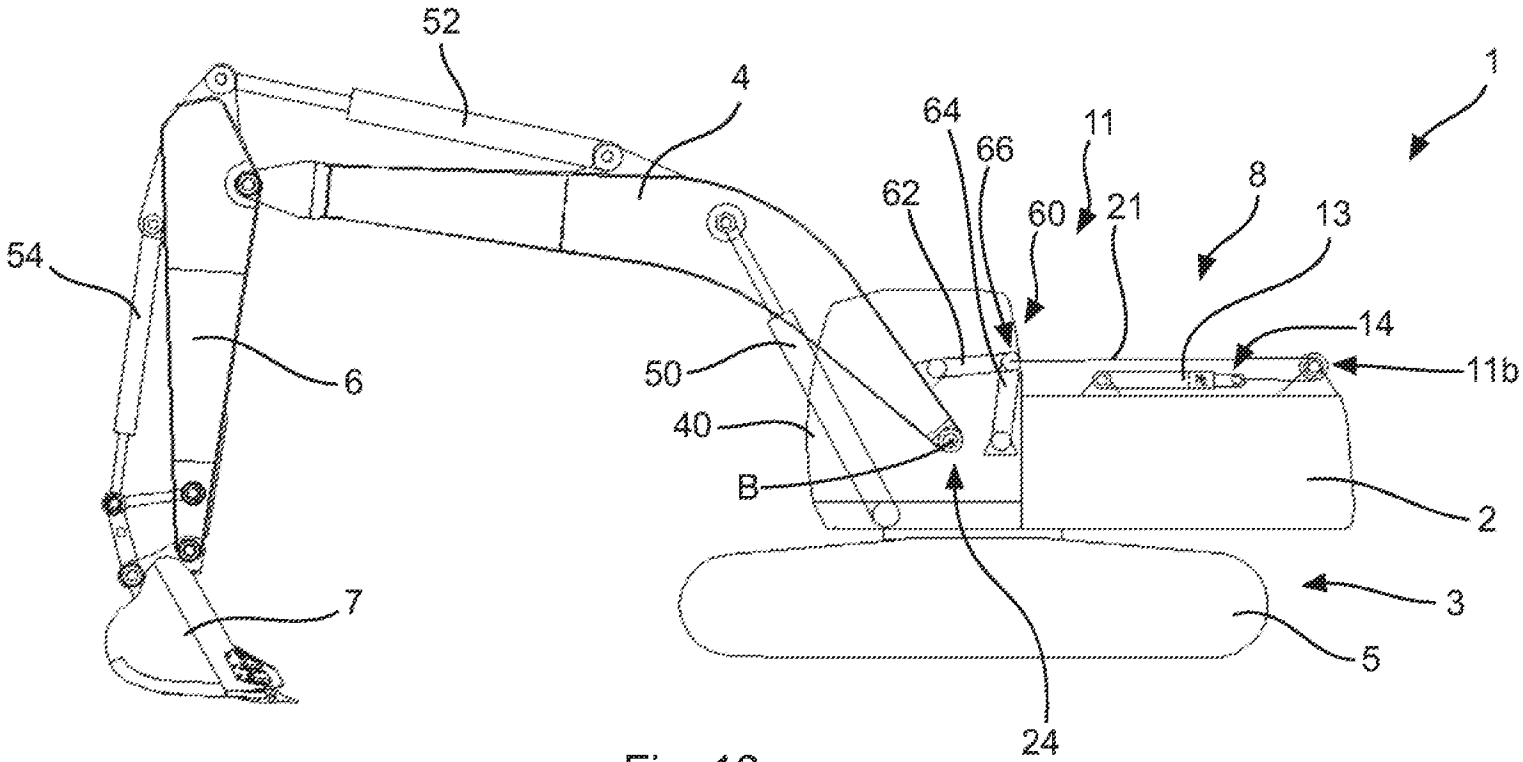

FIG. 18 shows a configuration of an excavator 1 according to a further embodiment which differs from the configuration as shown in FIGS. 4A, 4B and 4C only in that instead of coupling device 20 a link mechanism 60 according to the embodiment as shown in FIG. 15 is used.

Figure 19:
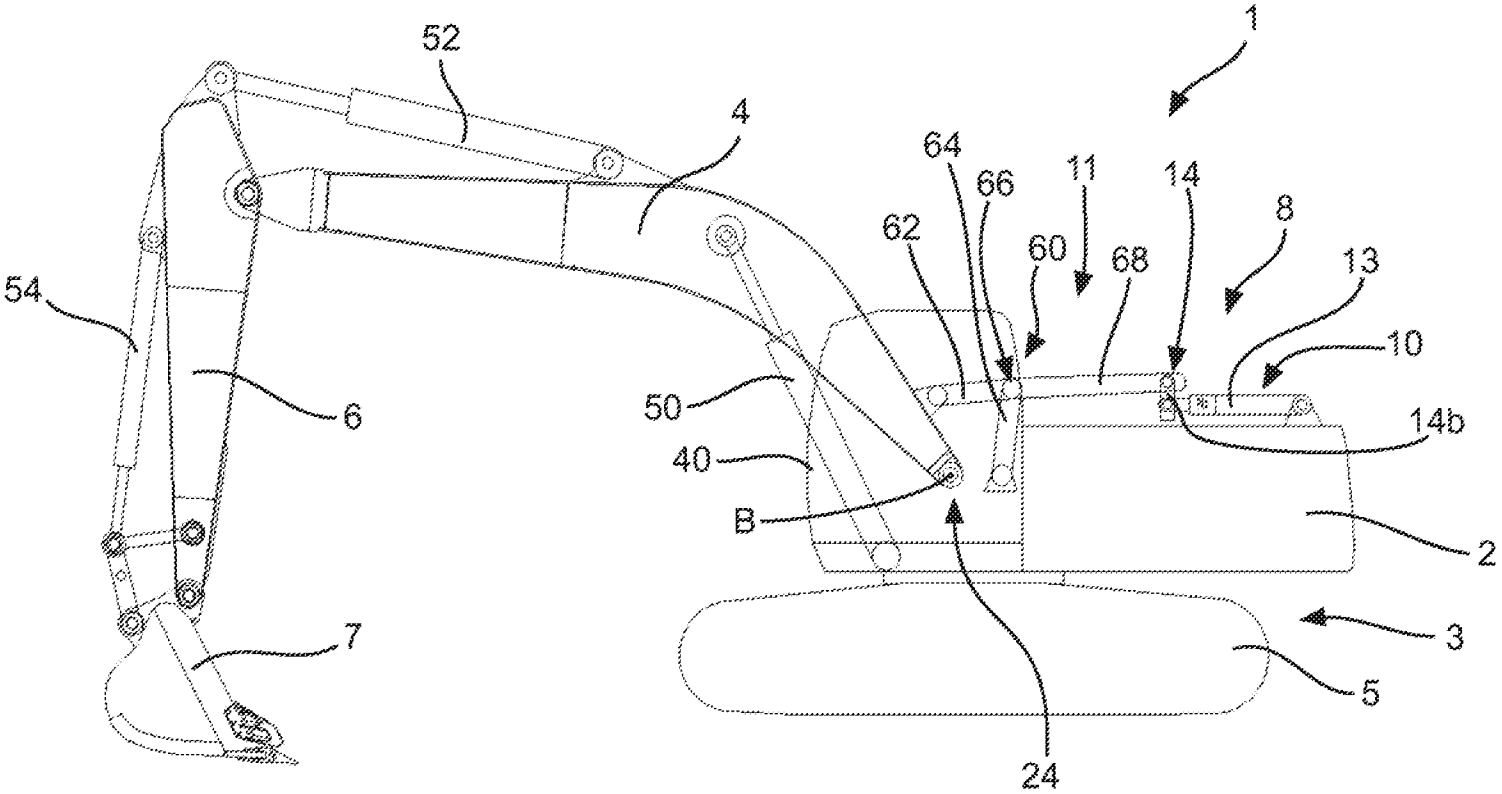

FIG. 19 shows a configuration of an excavator 1 according to a further embodiment which differs from the configuration as shown in FIG. 15 in that the force transfer mechanism is entirely constructed from rigid links 14*a*, 62, 64, and 68. In other words, the wire rope 21 as well as the deflection pulley 11*c* are replaced by links 68 and 14*a*. As regards the link 14*a*, reference is made to the above embodiments which also include this link 14*a*.

Figure 20:
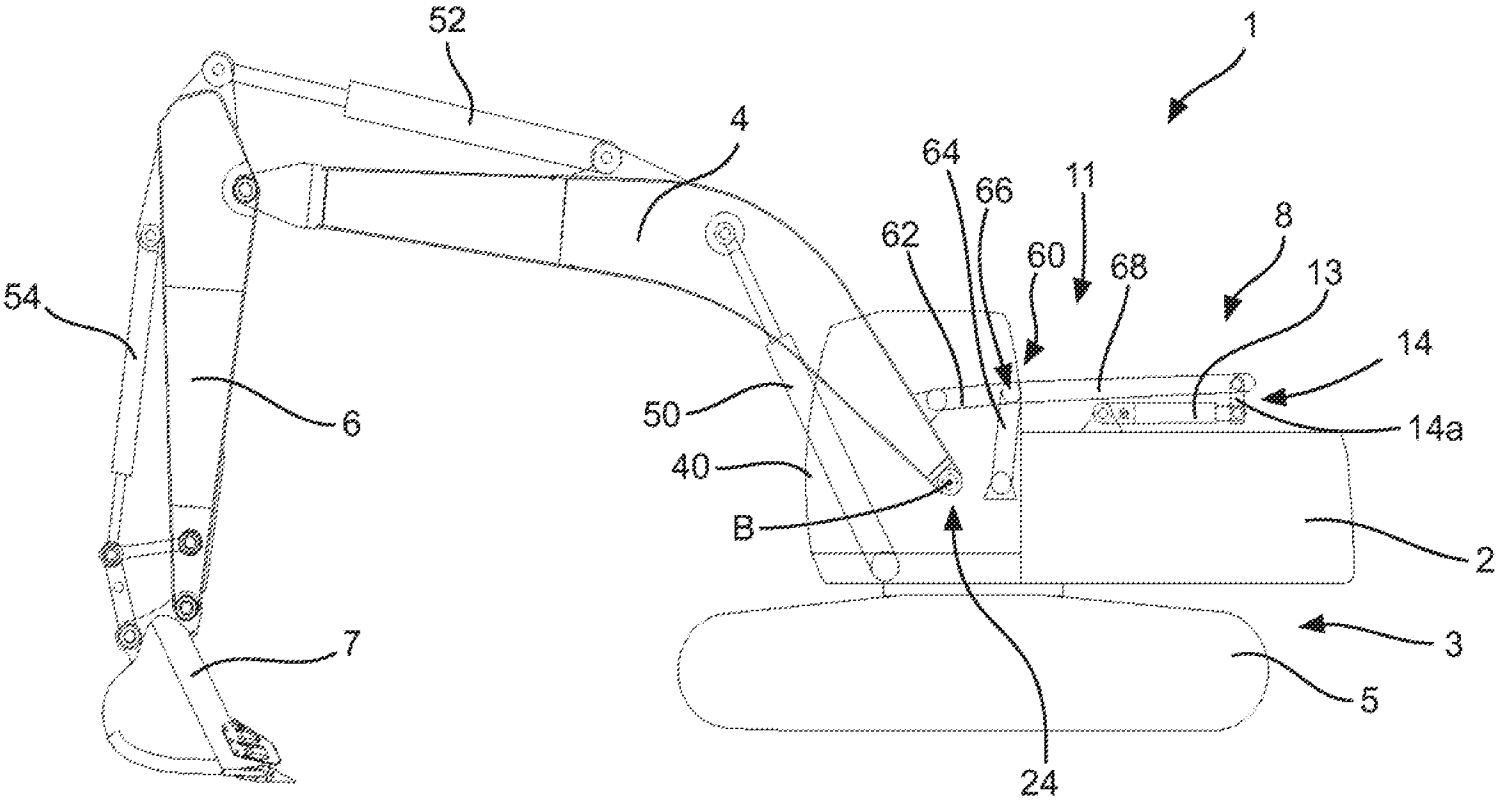

FIG. 20 shows a configuration of an excavator 1 according to a further embodiment which differs from the configuration as shown in FIG. 19 in that the pressure cylinder is inversely arranged and exerts a pushing force.

Figure 21:
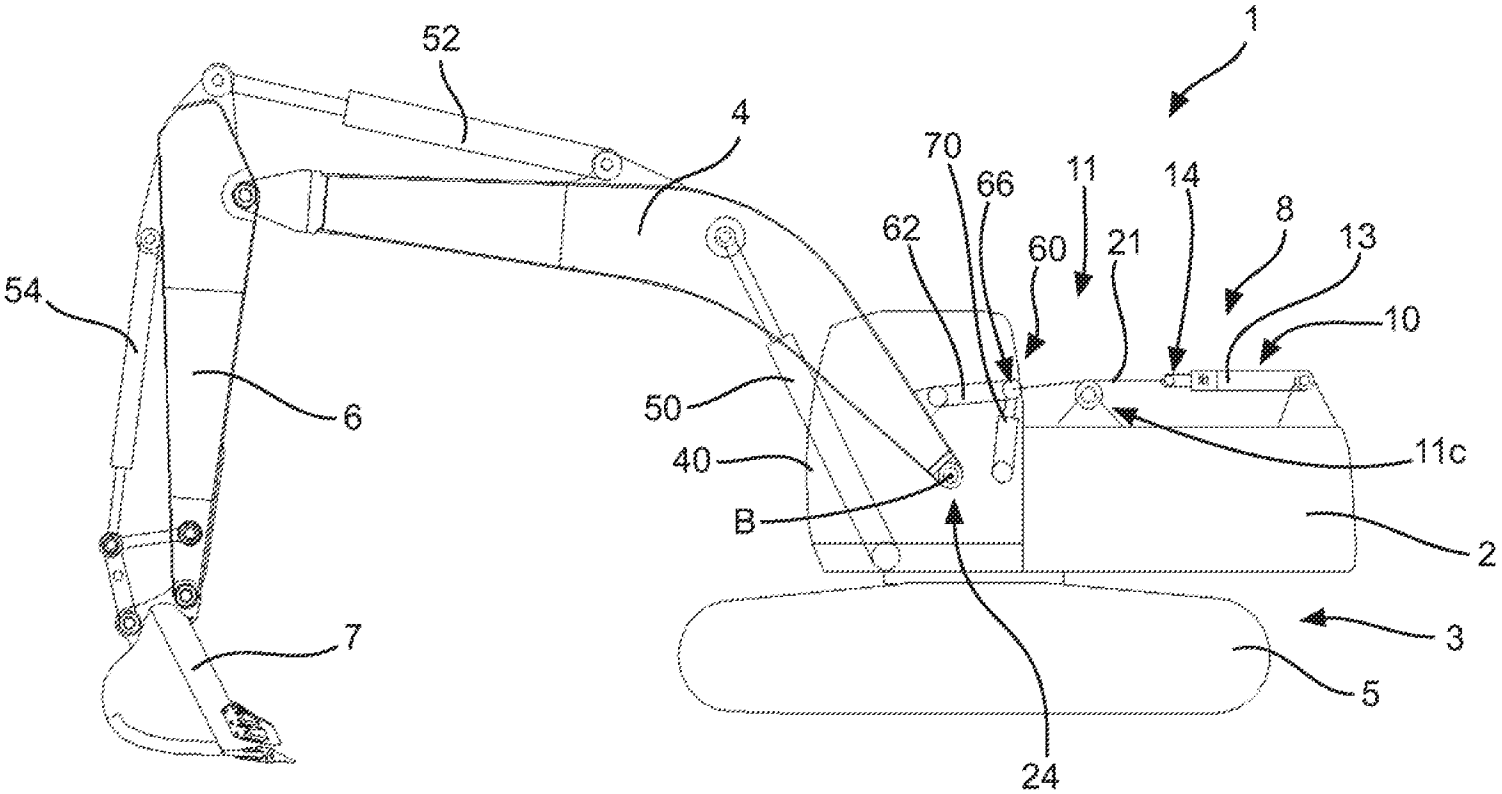

FIG. 21 shows a configuration of an excavator 1 according to a further embodiment which differs from the configuration as shown in FIG. 15 in that the link mechanism 60 comprises a length adjustable hydraulic cylinder 70. By adjusting the length of the hydraulic cylinder 70 a transmission ratio of the force applied on the boom 4 by link 62 can be adjusted.

Figure 22:
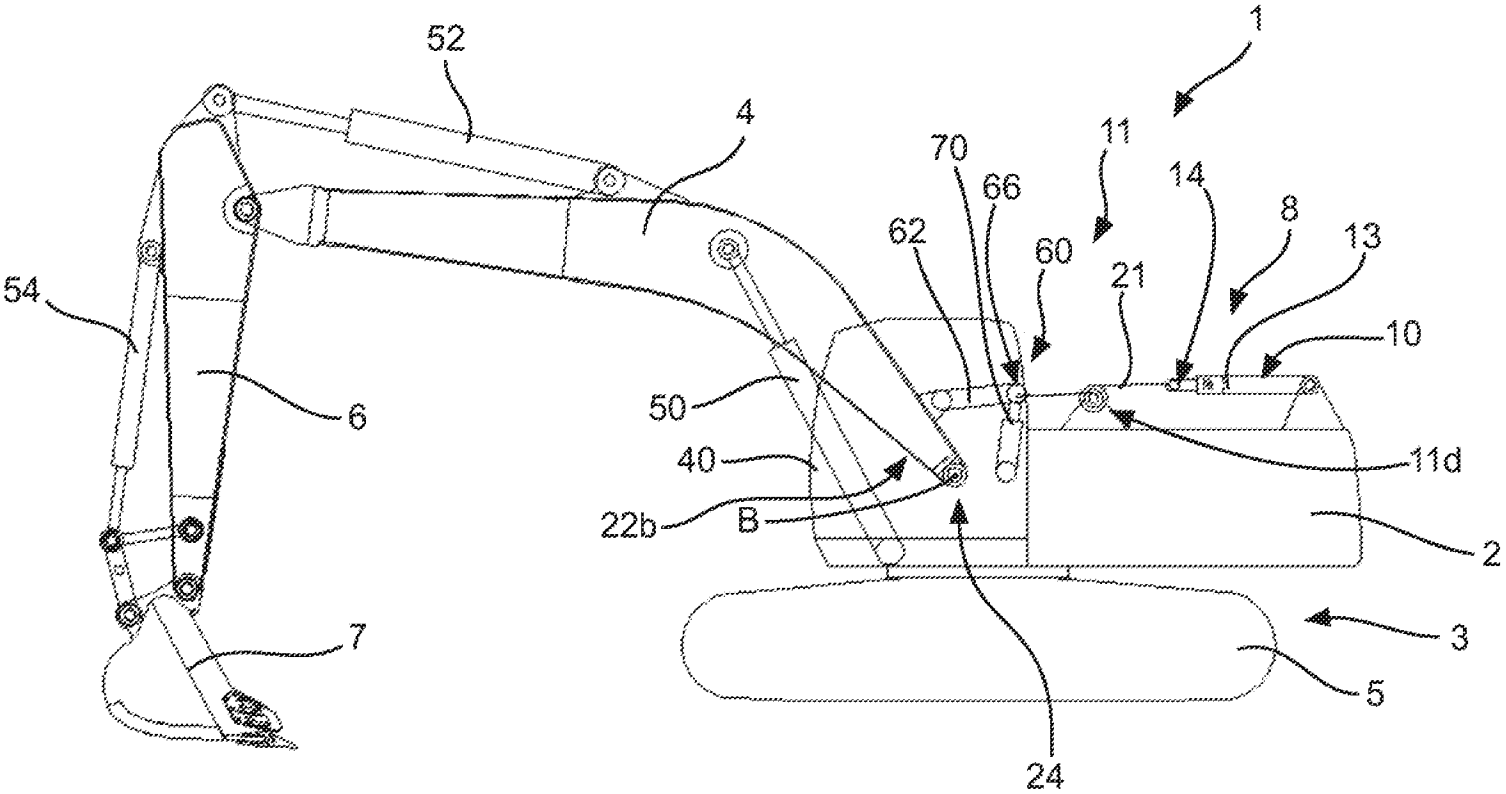

FIG. 22 shows a configuration of an excavator 1 according to a further embodiment which differs from the configuration as shown in FIG. 16 in that the link mechanism 60 comprises a length adjustable hydraulic cylinder 70 as described with respect to the embodiment shown in FIG. 21.

Figure 23:
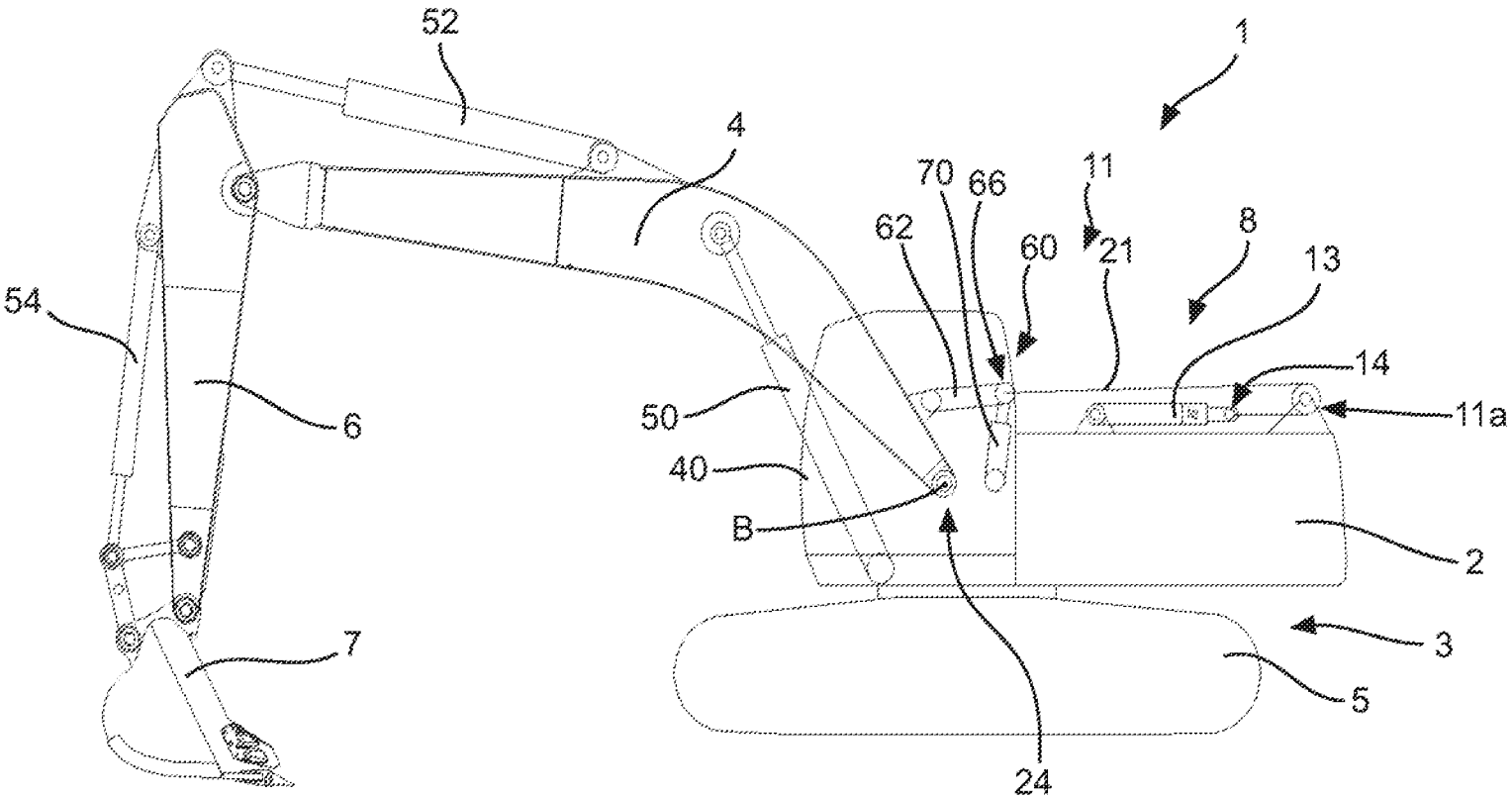

FIG. 23 shows a configuration of an excavator 1 according to a further embodiment which differs from the configuration as shown in FIG. 17 in that the link mechanism 60 comprises a length adjustable hydraulic cylinder 70 as described with respect to the embodiment shown in FIG. 21.

Figure 24:
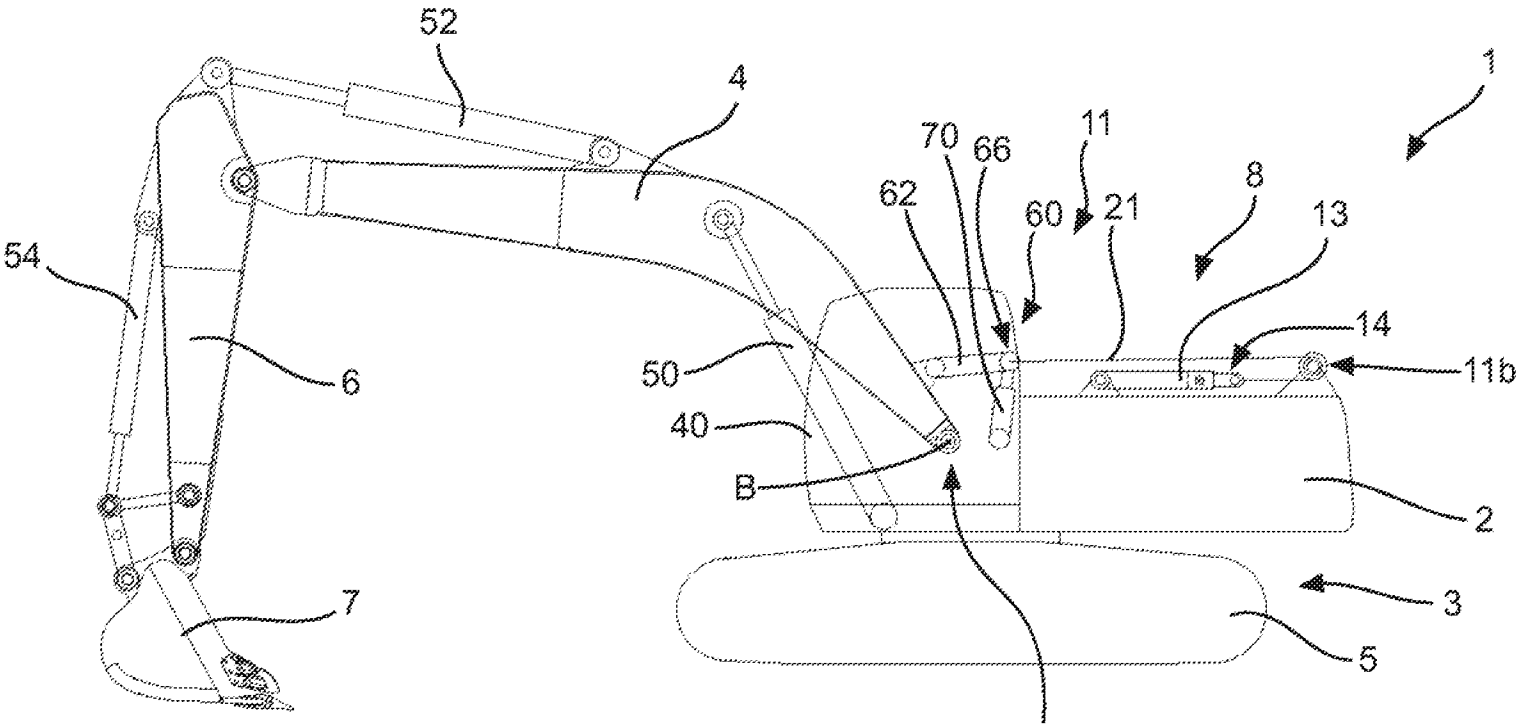

FIG. 24 shows a configuration of an excavator 1 according to a further embodiment which differs from the configuration as shown in FIG. 18 in that the link mechanism 60 comprises a length adjustable hydraulic cylinder 70 as described with respect to the embodiment shown in FIG. 21.

Figure 25:
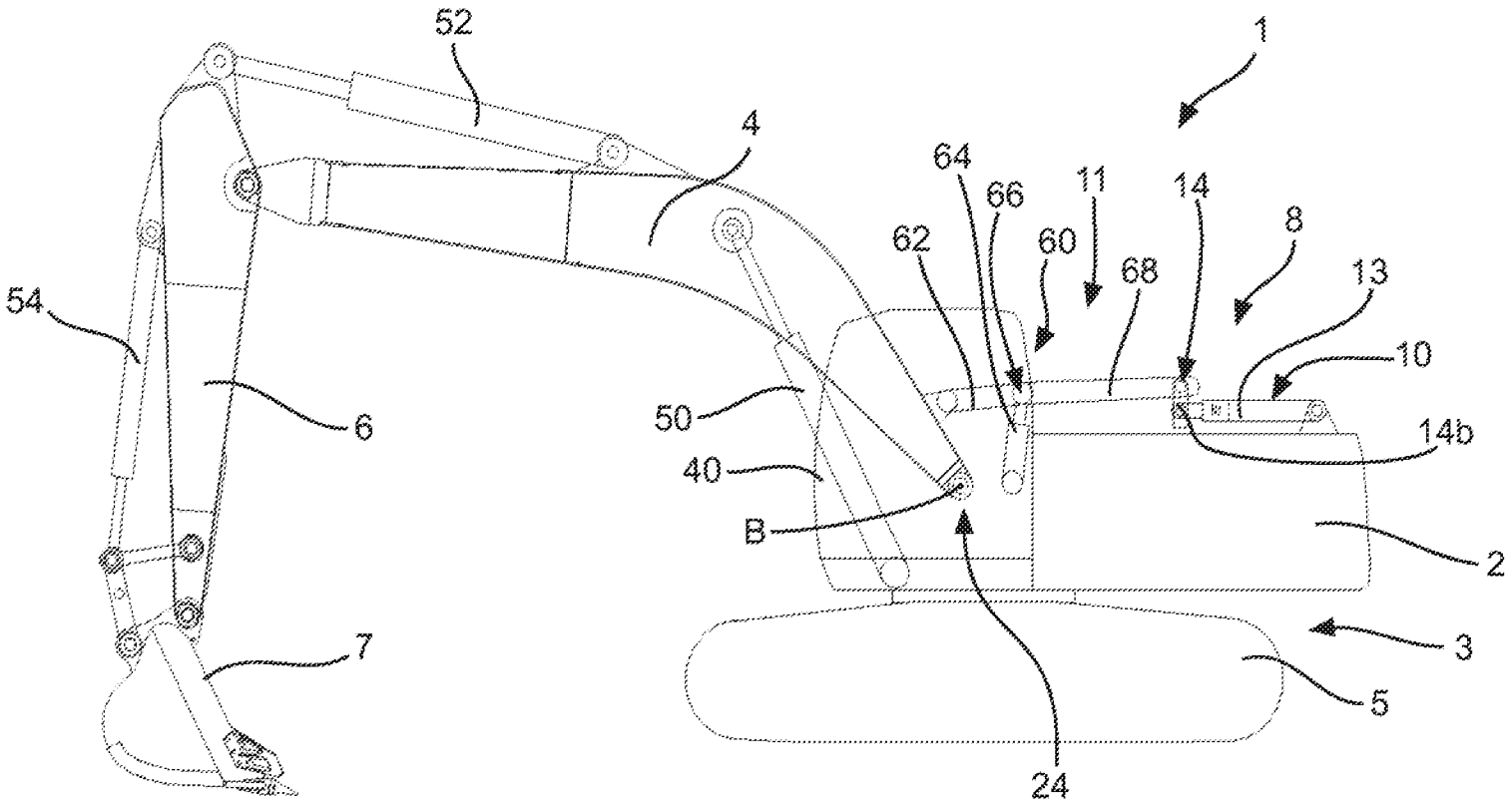
Figure 26:
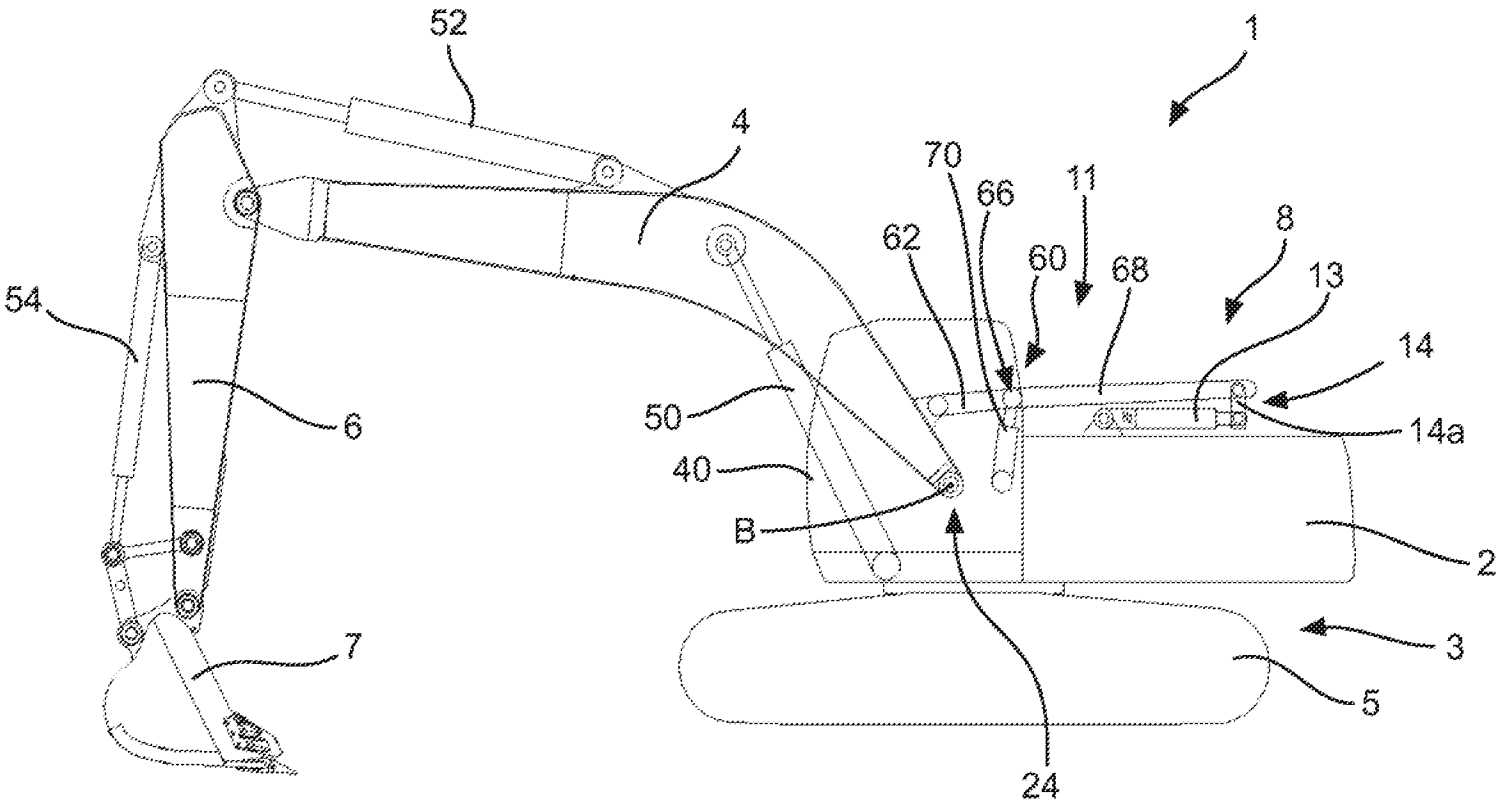

FIG. 25 shows a configuration of an excavator 1 according to a further embodiment which differs from the configuration as shown in FIG. 19 in that the link mechanism 60 comprises a length adjustable hydraulic cylinder 70 as described with respect to the embodiment shown in FIG. 21.

It is to be noted that buckets of different sizes can be used on the bucket arm. Furthermore, it is also possible to use other tools instead of the bucket. The load transfer mechanism 11 can be adapted to the bucket size or tool used in order to assist a movement of the boom in the upward direction in an optimum way. For that, it is possible to provide elements with adjustable transmission ratios. For example, the force transfer device can be arranged releasably locked to the boom and can be exchanged with another force transfer device having a different shape and better suiting the tool or bucket size as mounted. It is also possible to provide a force transfer device having several different force transfer sections in a direction of the axis B and a force transfer changing mechanism being able to shift between the force transfer sections in order to adapt the force transfer device to the bucket size or load.

In conclusion, it is pointed out that terms like "comprising" or the like are not intended to rule out the provision of additional elements or steps. Let it further be noted that "a" or "an" do not preclude a plurality. In addition, features described in conjunction with the different embodiments can be combined with each other however desired. It is also noted that the reference numbers in the claims are not to be construed as limiting the scope of the claims. Moreover, while at least one exemplary embodiment has been presented in the foregoing summary and detailed description, it should be appreciated that a vast number of variations exist.

It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

The invention claimed is:

1. An excavator comprising:

an articulated boom; and a balancing mechanism that assists a movement of the articulated boom from a lower position to an upper position by applying a pulling force on the articulated boom, wherein the balancing mechanism comprises a balancing member that generates an assisting force and a force transfer mechanism that couples the balancing member with the articulated boom, wherein the force transfer mechanism comprises a link mechanism, wherein the link mechanism comprises a rigid force transfer link coupled to the articulated boom at one end thereof and a guiding link coupled to a platform of the excavator at one end thereof, wherein the rigid force transfer link and the guiding link are connected at their respective other ends at a connecting portion of both links, wherein the balancing member is coupled to the connecting portion, and wherein the link mechanism transfers the assisting force from the balancing member to the articulated boom at a transmission ratio independent from a position of the articulated boom.

2. The excavator of claim 1, wherein the articulated boom is hingedly coupled to the platform of the excavator, wherein the rigid force transfer link is hingedly coupled to the articulated boom at the one end thereof, and wherein the guiding link is hingedly coupled to the platform at the one end thereof.

3. The excavator of claim 1, wherein the balancing member is coupled to the connecting portion by another rigid force transfer link.

4. The excavator of claim 1, wherein the balancing member comprises a pressure cylinder.

5. The excavator of claim 4, wherein the pressure cylinder is inversely arranged and exerts a pushing force.

6. The excavator of claim 1, wherein the guiding link comprises a length-adjustable hydraulic cylinder.

7. The excavator of claim 6, wherein the transmission ratio of the assisting force applied on the articulated boom by the link mechanism is adjusted by adjusting a length of the length-adjustable hydraulic cylinder.

8. The excavator of claim 1, wherein the link mechanism comprises another rigid force transfer link connected at one end thereof to the connecting portion of the link mechanism.

9. The excavator of claim 8, wherein one of the rigid force transfer links is hingedly coupled at its respective ends to the articulated boom and the connecting portion.

10. The excavator of claim 9, wherein the other of the rigid force transfer links is hingedly coupled at its respective ends to the balancing member and the connecting portion.

11. An excavator comprising:

a platform;

an articulated boom hingedly coupled to the platform; and a balancing mechanism at least partially assisting a movement of the articulated boom from a lower position to an upper position by applying a pulling force on the articulated boom, wherein the balancing mechanism comprises a balancing member configured and arranged for generating an assisting force, wherein the balancing member comprises a pressure cylinder, wherein the balancing mechanism further comprises a link mechanism indirectly and force-transmittingly coupling the balancing member with the articulated boom for transferring the assisting force to the articulated boom via the link mechanism, wherein the link mechanism comprises a rigid force transfer link hingedly coupled to the articulated boom at one end thereof, another rigid force transfer link hingedly coupled to the balancing member at one end thereof, and a guiding link hingedly coupled to the platform at one end thereof, wherein the guiding link comprises a length-adjustable hydraulic cylinder, and wherein the rigid force transfer links and the guiding link are connected at their respective other ends forming a connecting portion of the three links.

12. The excavator of claim 11, wherein a transmission ratio of the assisting force applied on the articulated boom by the link mechanism is adjusted by adjusting a length of the length-adjustable hydraulic cylinder.

13. The excavator of claim 11, wherein the pressure cylinder is inversely arranged and exerts a pushing force.

* * * * *